United States Patent [19]

Yagihara et al.

[11] Patent Number: 4,495,272

[45] Date of Patent: Jan. 22, 1985

[54] SILVER HALIDE COLOR PHOTOGRAPHIC LIGHT-SENSITIVE MATERIAL

[75] Inventors: Morio Yagihara; Tsumoru Hirano; Mitsunori Hirano; Makoto Umemoto, all of Kanagawa, Japan

[73] Assignee: Fuji Photo Film Co., Ltd., Kanagawa,

[21] Appl. No.: 513,181

[22] Filed: Jul. 12, 1983

[30] Foreign Application Priority Data

Jul. 12, 1982 [JP] Japan ..... 57-120857

[51] Int. Cl.[3] ..... G03C 7/16

[52] U.S. Cl. ..... 430/381; 430/384; 430/505; 430/548; 430/552

[58] Field of Search ..... 430/381, 384, 552, 548, 430/505

[56] References Cited

U.S. PATENT DOCUMENTS 3,767,412 10/1973 Monbaliu et al. ..... 430/548
3,926,436 12/1975 Monbaliu et al. ..... 430/552
4,128,427 12/1978 Monbaliu et al. ..... 430/552

*Primary Examiner*—J. Travis Brown
*Attorney, Agent, or Firm*—Sughrue, Mion, Zinn, Macpeak, and Seas

[57] ABSTRACT

A silver halide color photographic light-sensitive material comprising a support having thereon a silver halide emulsion layer containing a cyan color image forming polymer coupler latex capable of forming a dye upon coupling with an oxidation product of an artomatic primary amine developing agent wherein the cyan color image forming polymer coupler latex contains at least one repeating unit represented by the general formula (I) described below and at least one repeating unit represented by the general formula (II) described below.

(I)

wherein $R_1$ represents a hydrogen atom, a lower alkyl group containing from 1 to 4 carbon atoms or a chlorine atom; and Q represents a cyan coupler residue capable of forming a dye upon coupling with an oxidized aromatic primary amine developing agent, (II)

wherein $R_2$ represents a hydrogen atom, a lower alkyl group containing from 1 to 4 carbon atoms or a chlorine atom; and $R_3$ and $R_4$, which may be the same or different, each represents a hydrogen atom, an unsubstituted or substituted alkyl group which may be a straight chain, a branched chain or a cyclic, or an unsubstituted or substituted phenyl group.

The cyan color image forming polymer coupler latex has an excellent color forming property, and the silver halide color photographic light-sensitive material containing the cyan color image forming polymer coupler latex has good film strength and a reduced layer thickness and provides a cyan image having improved color reproduction properties and sharpness and a good fastness to heat with or without humidity. A method of forming a color image using the silver halide color photographic light-sensitive material is also described.

23 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material containing a novel cyan color image forming polymer coupler latex capable of coupling with an oxidation product of an aromatic primary amine developing agent.

BACKGROUND OF THE INVENTION

It is well known that upon the color development of a silver halide photographic light-sensitive material, after exposure, an oxidized aromatic primary amine developing agent can be reacted with a dye forming coupler to obtain a color image.

It is also known that, for the color development of a silver halide color photographic material, an oxidized aromatic primary amine color developing agent can be reacted with a coupler to form a dye such as an indophenol, an indoaniline, an indamine, an azomethine, a phenoxazine, a phenazine, and the like, thus forming a color image. In this procedure, the subtractive color process is ordinarily used for color reproduction, and silver halide emulsions which are selectively sensitive to blue, green and red lights, and yellow, magenta and cyan color image formers, which are respectively the complementary colors of blue, green and red, are employed. For example, a coupler of the acylacetanilide or benzoylmethane type is used for forming a yellow color image; a coupler of the pyrazolone, pyrazolobenzimidazole, cyanoacetophenone or indazolone type is generally used for forming a magenta color image; and a phenolic coupler, such as a phenol and a naphthol, is generally used for forming a cyan color image.

Color couplers must satisfy various requirements. For example, it is necessary that they have a good spectral property and provide a dye image having excellent stability to light, temperature, and humidity for a long period of time upon color development.

It is also required in a multilayer color photographic light-sensitive material that each coupler is fixed in a layer separated from each other in order to reduce color mixing and improve color reproduction. Many methods for rendering a coupler diffusion-resistant are known. One method is to introduce a long chain aliphatic group into a coupler molecule in order to prevent diffusion. Couplers according to such a method require a step of addition to an aqueous gelatin solution by solubilizing in alkali, or a step of dispersing in an aqueous gelatin solution by dissolving in an organic solvent having a high boiling point, since the couplers are immiscible with an aqueous gelatin solution. Such color couplers may cause crystal formation in a photographic emulsion. Furthermore, when using an organic solvent having a high boiling point, a large amount of gelatin must be employed since the organic solvent having a high boiling point makes an emulsion layer soft. Consequently, this increases the thickness of the material even though it is desirable to reduce the thickness of the emulsion layer.

Another method for rendering a coupler diffusion-resistant is to utilize a polymer coupler latex obtained by polymerization of a monomeric coupler. An example of a method of adding a polymer coupler in a latex form to a hydrophilic colloid composition is a method in which a latex prepared by an emulsion polymerization method is directly added to a gelatino silver halide emulsion and a method in which an oleophilic polymer coupler obtained by polymerization of a monomeric coupler is dispersed in a latex form in an aqueous gelatin solution. Some examples of the former emulsion polymerization methods include an emulsion polymerization method in an aqueous gelatin phase as described in U.S. Pat. No. 3,370,952 and an emulsion polymerization method in water as described in U.S. Pat. No. 4,080,211. An example of the latter method in which an oleophilic polymer coupler is dispersed in a latex form is described in U.S. Pat. No. 3,451,820. The method of adding a polymer coupler in a latex form to a hydrophilic colloid composition has many advantages in comparison with other methods. For example, the deterioration of strength of the film formed is small, because the hydrophobic substance is in a latex form. Also, since the latex can contain coupler monomers in a high concentration, it is easy to incorporate couplers in a high concentration into a photographic emulsion, and since the increase of viscosity is small, it is possible to reduce the thickness of the emulsion layer which results in the improvement in sharpness. Furthermore, color mixing is prevented, since a polymer coupler is completely immobilized and the crystallization of couplers in the emulsion layer is small.

With respect to the addition of these polymer couplers in a latex form to a gelatino silver halide emulsion, there are described, for example, 4-equivalent magenta polymer coupler latexes and methods of preparation thereof in U.S. Pat. No. 4,080,211, British Pat. No. 1,247,688, and U.S. Pat. No. 3,451,820, copolymer latexes with a competing coupler in West German Pat. No. 2,725,591, and U.S. Pat. No. 3,926,436 and cyan polymer coupler latexes in U.S. Pat. No. 3,767,412 and *Research Disclosure,* No. 21728 (1982).

However, these cyan polymer coupler latexes have unsolved problems as well as many excellent features such as those described above, and thus it has been desired to overcome these problems. The problems include the following:

1. The fastness to heat with or without humidity of the cyan color image in a color photograph after development processing is inferior.

2. The rate of the coupling reaction is poor, and thus sensitivity, gradation and color density of the dye image formed are low.

There is a particularly strong need with respect to improvement in heat fastness.

SUMMARY OF THE INVENTION

Therefore, an object of the present invention is to provide a novel cyan color image forming polymer coupler latex which forms a color image fast to heat with or without humidity in a color photograph after development processing.

Another object of the present invention is to provide a novel cyan color image forming polymer coupler latex which has an excellent color forming property.

A further object of the present invention is to provide a method of forming a cyan color image by development of a silver halide emulsion in the presence of a novel cyan color image forming polymer coupler latex.

A still further object of the present invention is to provide a silver halide color photographic light-sensitive material containing a novel cyan color image forming polymer coupler latex, a photographic processing method or an image forming method for using the material.

Other objects of the present invention will be apparent from the following detailed description and examples.

As a result of extensive investigations, it has now been found that these objects of the present invention are accomplished by the use of a cyan color image forming polymer coupler latex which contains (1) at least one cyan coupler repeating unit represented by the following general formula (I):

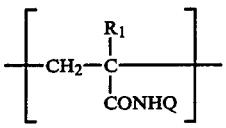

(I)

wherein $R_1$ represents a hydrogen atom, a lower alkyl group containing from 1 to 4 carbon atoms or a chlorine atom; and Q represents a cyan coupler residue capable of forming a dye upon coupling with an oxidized aromatic primary amine developing agent, and (2) at least one repeating unit represented by the following general formula (II):

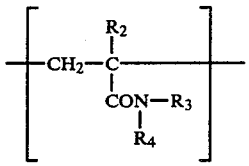

(II)

wherein $R_2$ represents a hydrogen atom, a lower alkyl group containing from 1 to 4 carbon atoms or a chlorine atom; and $R_3$ and $R_4$, which may be the same or different, each represents a hydrogen atom, an unsubstituted or substituted alkyl group which may be a straight chain, a branched chain or a cyclic, or an unsubstituted or substituted phenyl group.

In more detail, the objects of the invention can be accomplished with a color photographic light-sensitive material comprising a support having thereon at least one silver halide emulsion layer containing the cyan color image forming polymer coupler latex as described above.

DETAILED DESCRIPTION OF THE INVENTION

In the general formula (I) described above, the cyan coupler residue represented by Q includes a cyan color forming phenol type or naphthol type coupler residue. The repeating unit represented by the general formula (II) described above is a repeating unit derived from an ethylenically unsaturated monomer which does not have an ability of oxidative coupling with an aromatic primary amine developing agent (for example, an amide derived from an acrylic acid, for example, acrylic acid, an α-alkylacrylic acid (such as methacrylic acid, etc.), or α-chloroacrylic acid, etc.).

In more detail, preferred cyan coupler residue for Q which forms a cyan color image upon coupling with an oxidized aromatic primary amine developing agent in the cyan color image forming polymer coupler latex according to the present invention includes a phenol type residue represented by the general formula (III) or (IV) described below and a naphthol type residue represented by the general formula (V) described below.

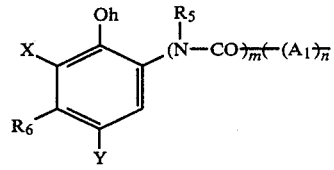

(III)

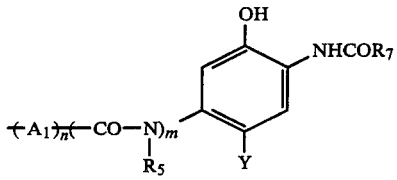

(IV)

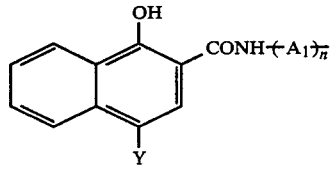

(V)

In the above formulae, $R_5$ represents a hydrogen atom or a lower alkyl group having from 1 to 4 carbon atoms; $A_1$ bonds to the NH group in the general formula (I) and represents an unsubstituted or substituted alkylene group having from 1 to 10 carbon atoms, an unsubstituted or substituted aralkylene group having from 7 to 12 carbon atoms or an unsubstituted or substituted phenylene group, where the alkylene group and an alkylene moiety in the aralkylene group may be a straight chain or a branched chain. Examples of the alkylene group for $A_1$ include a methylene group, a methylmethylene group, a dimethylmethylene group, a dimethylene group, a trimethylene group, a tetramethylene group, a pentamethylene group, a hexamethylene group, a decylmethylene group, etc. Examples of the aralkylene group for $A_1$ includes a benzylidene group, etc. Examples of the phenylene group for $A_1$ include a p-phenylene group, an m-phenylene group, a methylphenylene group, etc. $R_6$ represents a hydrogen atom or a lower alkyl group having from 1 to 5 carbon atoms (for example, a methyl group, an ethyl group, a tert-butyl group, etc.). $R_7$ represents an unsubstituted or substituted alkyl group having from 1 to 20 carbon atoms, an unsubstituted or substituted phenyl group or an unsubstituted or substituted phenylamino group. X represents a halogen atom (for example, a fluorine atom, a chlorine atom, a bromine atom, etc.). Y represents a hydrogen atom, a halogen atom (for example, a fluorine atom, a chlorine atom, a bromine atom, etc.) or a substituted alkoxy group having from 1 to 20 carbon atoms. m represents 0 or 1; and n represents 0 or 1.

Substituents for the alkylene group, the aralkylene group or the phenylene group represented by $A_1$ include an aryl group (for example, a phenyl group, etc.), a nitro group, a hydroxy group, a cyano group, a sulfo group, an alkoxy group (for example, a methoxy group, etc.), an aryloxy group (for example, a phenoxy group, etc.), an acyloxy group (for example, an acetoxy group, etc.), an acylamino group (for example, an acetylamino group, etc.), a sulfonamido group (for example, a methanesulfonamido group, etc.), a sulfamoyl group (for example, a methylsulfamoyl group, etc.), a halogen atom (for example, a fluorine atom, a chlorine atom, a bromine atom, etc.), a carboxy group, a carbamoyl group (for example, a methylcarbamoyl group, etc.), an alkoxycarbonyl group (for example, a methoxycarbonyl group, etc.), a sulfonyl group (for example, a methylsulfonyl group, etc.), and the like. When two or more substituents are present, they may be the same or different.

Substituents for the substituted alkoxy group represented by Y include an aryl group (for example, a phenyl group, etc.), a nitro group, a hydroxy group, a cyano group, a sulfo group, an alkoxy group (for example, a methoxy group, etc.), an aryloxy group (for example, a phenoxy group, etc.), an acyloxy group (for example, an acetoxy group, etc.), an acylamino group (for example, an acetylamino group, etc.), an alkylsulfonamido group (for example, a methanesulfonamido group, etc.), an alkylsulfamoyl group (for example, a methylsulfamoyl group, etc.), a halogen atom (for example, a fluorine atom, a chlorine atom, a bromine atom, etc.), a carboxy group, an alkylcarbamoyl group (for example, a methylcarbamoyl group, etc.), an alkoxycarbonyl group (for example, a methoxycarbonyl group, etc.), an alkylsulfonyl group (for example, a methylsulfonyl group, etc.), an alkylthio group (for example, a $\beta$-carboxyethylthio group, etc.), and the like. When two or more substituents are present, they may be the same or different.

Substituent for the alkyl group or the phenyl group, represented by $R_7$ is preferably a fluorine atom. Substituents for the phenylamino group represented by $R_7$ include a nitro group, a cyano group, a sulfonamido group (for example, a methanesulfonamido group, etc.), a sulfamoyl group (for example, a methylsulfamoyl group, etc.), a halogen atom (for example, a fluorine atom, a chlorine atom, a bromine atom, etc.), a carbamoyl group (for example, a methylcarbamoyl group, etc.), a sulfonyl group (for example, a methylsulfonyl group, etc.), and the like. When two or more substituents are present, they may be the same or different.

The repeating unit represented by the general formula (II) above which is derived from an ethylenically unsaturated monomer which does not have an ability of oxidative coupling with an aromatic primary amine developing agent includes an amide derived from an acrylic acid, for example, acrylic acid, $\alpha$-chloroacrylic acid, an $\alpha$-alkylacrylic acid (such as methacrylic acid, etc.), etc. Substituents for the alkyl group or the phenyl group represented by $R_3$ or $R_4$ in the general formula (II) include an acetyl group, a hydroxyacetyl group, an acetoacetoxy group, an alkylcarbonyl group, a dialkylamino group, an alkoxycarbonyl group, a hydroxy group, an alkoxy group, a cyano group, and the like. When two or more substituents are present, they may be the same or different.

Specific examples of the monomer corresponding to the general formula (II) include n-butylacrylamide, t-butylacrylamide, n-octylacrylamide, diacetoneacrylamide, hydroxymethylacrylamide, acrylamide, $\alpha$-chloroacrylamide, n-butylmethacrylamide, t-butylmethacrylamide, methacrylamide, etc.

Furthermore, for the cyan color image forming polymer coupler latex according to the present invention, it is possible to copolymerize one or more of non-color forming monomers in addition to the non-color forming ethylenically unsaturated monomer corresponding to the general formula (II). Specific examples of such non-color forming monomers include an ester derived from an acrylic acid, for example, acrylic acid, $\alpha$-chloroacrylic acid, an $\alpha$-alkylacrylic acid such as methacrylic acid, etc., (for example, methyl acrylate, ethyl acrylate, n-propyl acrylate, n-butyl acrylate, t-butyl acrylate, isobutyl acrylate, 2-ethylhexyl acrylate, n-octyl acrylate, lauryl acrylate, ethyl $\alpha$-chloroacrylate, methyl methacrylate, ethyl methacrylate, n-butyl methacrylate, ethyl $\beta$-hydroxymethacrylate, etc.); a vinyl ester (for example, vinyl acetate, vinyl propionate, vinyl laurate, etc.); acrylonitrile; methacrylonitrile; an aromatic vinyl compound (for example, styrene and a derivative thereof, for example, vinyl toluene, divinyl benzene, vinyl acetophenone, sulfostyrene, etc.); itaconic acid; citraconic acid; crotonic acid; vinylidene chloride; a vinyl alkyl ether (for example, vinyl ethyl ether, etc.); an ester of maleic acid; N-vinyl-2-pyrrolidone; N-vinylpyridine; 2- or 4-vinylpyridine, etc.

Of these monomers, an ester of acrylic acid, an ester of methacrylic acid, an ester of maleic acid are particularly preferred.

Two or more non-color forming ethylenically unsaturated monomers described above can be used together. For example, a combination of methyl acrylate and n-butyl acrylate, methyl acrylate and ethyl methacrylate, styrene and n-butyl acrylate, etc., can be employed.

The ethylenically unsaturated monomer which is used to copolymerize with the monomer coupler corresponding to the above-described general formula (I) can be selected so that the copolymer to be formed possesses good physical properties and/or chemical properties, for example, solubility, compatibility with a binder such as gelatin in a photographic colloid composition, flexibility, heat stability, etc., as well known in the field of polymer color couplers.

The cyan polymer coupler latex used in the present invention can be prepared, as described above, by dissolving an oleophilic polymer coupler obtained by polymerization of a monomer coupler in an organic solvent and then dispersing the solution in a latex form in an aqueous gelatin solution, or can be directly prepared by an emulsion polymerization method. With respect to the method in which an oleophilic polymer coupler is dispersed in a latex form in an aqueous gelatin solution, the method as described in U.S. Pat. No. 3,451,820 and with respect to the emulsion polymerization, the methods as described in U.S. Pat. Nos. 4,080,211 and 3,370,952 can be employed, respectively.

In the following, general polymerization methods for preparing the cyan polymer couplers are described.

Free radical polymerization of an ethylenically unsaturated solid monomer is initiated with the addition to the monomer molecule of a free radical which is formed by thermal decomposition of a chemical initiator, an action of a reducing agent to an oxidative compound (a redox initiator) or a physical action, for example, irradiation of ultraviolet rays or other high energy radiations, high frequencies, etc.

Examples of the chemical initiators commonly used include a water-soluble initiator, for example, a persulfate (such as ammonium persulfate, potassium persulfate, etc.), hydrogen peroxide, 4,4'-azobis(4-cyanovaleric acid), etc., and a water-insoluble initiator, for example, azobisisobutyronitrile (such as 2,2'-azobis(2,4-dimethylvaleronitrile), 2,2'-azobisisobutyronitrile, etc.), dimethyl 2,2'-azobisisobutyrate, benzoyl peroxide, chlorobenzoyl peroxide, and other compounds. Examples of the redox initiators usually used include hydrogen peroxide-iron (II) salt, potassium persulfate-potassium hydrogensulfate, cerium salt-alcohol, etc. Specific examples and functions of the initiators are described in F. A. Bovey, *Emulsion Polymerization,* pages 59–93 (Interscience Publishers Inc., New York (1955)).

Organic solvents which can be used in polymerization of the oleophilic cyan polymer couplers are preferably those which can usually be admixed with monomers to be used without limitation, are good solvents for the oleophilic polymer couplers formed, do not react with initiators to be used and do not interrupt usual actions in free radical addition polymerization.

Specific examples of the organic solvents which can be used include an aromatic hydrocarbon (for example, benzene, toluene, etc.), a hydrocarbon (for example, hexane, etc.), an alcohol (for example, methanol, ethanol, isopropanol, tert-butanol, etc.), a ketone (for example, acetone, methyl ethyl ketone, etc.), a cyclic ether (for example, tetrahydrofuran, dioxane, etc.), an ester (for example, ethyl acetate, etc.), a chlorinated hydrocarbon (for example, methylene chloride, chloroform, etc.), an amide (for example, dimethylformamide, dimethylacetamide, etc.), a sulfoxide (for example, dimethyl sulfoxide, etc.), a nitrile (for example, acetonitrile, etc.), and a mixture thereof.

On the other hand, emulsion polymerization of solid water-insoluble monomer couplers is usually carried out in an aqueous system or a water/organic solvent system. Organic solvents which can be used are preferably those which are substantially inert to solid water-insoluble monomer couplers to be used, do not interrupt usual actions in free radical addition polymerization and have a low boiling point so as to be capable of being easily removed from an aqueous reaction medium by distillation during and/or after polymerization, same as the organic solvents described above. Preferred examples include a lower alcohol having from 1 to 4 carbon atoms (for example, methanol, ethanol, isopropanol, etc.), a ketone (for example, acetone, etc.), a chlorinated hydrocarbon (for example, chloroform, etc.), an aromatic hydrocarbon (for example, benzene, etc.), a cyclic ether (for example, tetrahydrofuran, etc.), an ester (for example, ethyl acetate, etc.), a nitrile (for example, acetonitrile, etc.), and the like.

As an emulsifier which can be used in the emulsion polymerization, a compound having surface activity is used. Preferred examples include soap, a sulfonate, a sulfate, a cationic compound, an amphoteric compound and a high molecular weight protective colloid. Specific examples and functions of the emulsifiers are described in *Belgische Chemische Industrie,* Vol. 28, pages 16–20 (1963).

Further, an organic solvent which is used for dissolving an oleophilic polymer coupler in the case where the oleophilic polymer coupler is dispersed in a latex form in an aqueous gelatin solution is removed from the mixture before coating of the dispersion solution or by vaporization during drying of the dispersion solution coated, although the latter is less preferable. With respect to removing the solvent, a method in which the solvent is removed by washing a gelatin noodle with water is applied when the solvent is water-soluble to some extent, or a spray drying method, a vacuum purging method or a steam purging method can be employed for removing the solvent.

Examples of the organic solvents which can be removed include, for example, an ester (for example, a lower alkyl ester, etc.), a lower alkyl ether, a ketone, a halogenated hydrocarbon (for example, methylene chloride, trichloroethylene, a fluorinated hydrocarbon, etc.), an alcohol (for example, an alcohol between n-butyl alcohol and octyl alcohol, etc.), and a mixture thereof.

Any type of dispersing agent can be used in the dispersion of the oleophilic polymer coupler. Ionic surface active agents, and particularly anionic surface active agents, are preferred. Amphoteric surface active agents such as C-cetyl betaine, an N-alkylaminopropionate, an N-alkyliminodipropionate, etc., can also be used.

In order to increase the dispersion stability, to improve the color forming property of a polymer coupler dispersed, to control the color hue of a dye formed from a polymer coupler dispersed and the oxidation product of an aromatic primary amine developing agent and to improve the bending property of the emulsion coated, a permanent solvent, that is, a water-immiscible organic solvent having a high boiling point (i.e., above 200° C.), may be added in a small amount. The concentration of the permanent solvent must be at such a low level that the copolymer is plasticized while it is maintained in solid particle form. Furthermore, it is desirable to use the permanent solvent in a relatively low concentration in order to reduce the thickness of a final emulsion layer as much as possible to obtain good sharpness.

It is desirable that a proportion of the color forming portion corresponding to the general formula (I) in the polymer coupler latex is usually from 5 to 80% by weight. Particularly, a proportion from 20 to 70% by weight is preferred in view of color reproducibility, color forming property and stability. Also, it is desirable that a proportion of the non-color forming portion corresponding to the general formula (II) in the polymer coupler latex is usually from 5 to 90% by weight. Particularly, a proportion from 10 to 70% by weight is preferred in view of color reproducibility, color forming property and fastness. In this case, an equivalent molecular weight, that is, a gram number of the polymer containing 1 mol of a monomer coupler is from about 250 to 4,000, but it is not limited thereto.

The polymer coupler latex is used in such that an amount of the color forming portion corresponding to the general formula (I) is from $2\times10^{-3}$ to $5\times10^{-1}$ mol/mol of silver.

Specific examples of monomer couplers (corresponding to the general formula (I)) suitable for preparing the cyan polymer coupler latex according to the present invention are described in various literature references, for example, U.S. Pat. Nos. 2,976,294, 3,767,412, 4,080,211 and 4,128,427, *Research Disclosure,* No. 21728, etc.

Representative examples of the monomer couplers (corresponding to the general formula (I)) which can be used in the present invention as set foth below, but the present invention is not to be construed as being limited thereto Monomer Coupler (1)

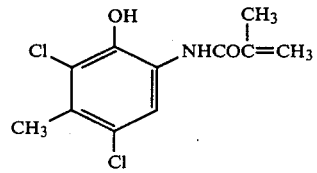

Monomer Coupler (2)

-continued
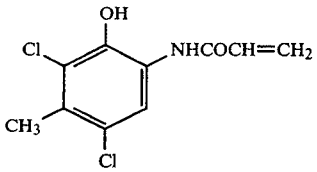
Monomer Coupler (3)
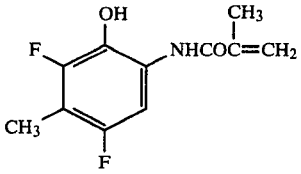
Monomer Coupler (4)
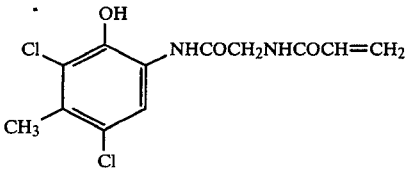
Monomer Coupler (5)
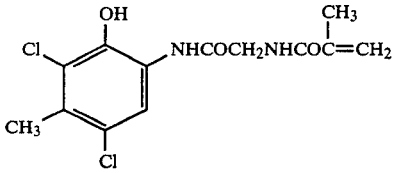
Monomer Coupler (6)
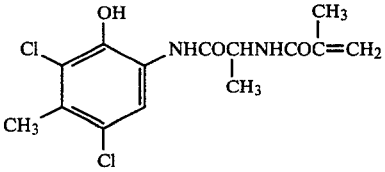
Monomer Coupler (7)
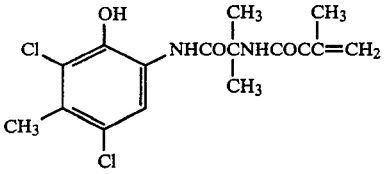
Monomer Coupler (8)
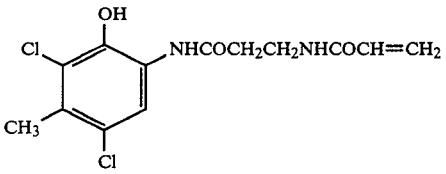
Monomer Coupler (9)
-continued
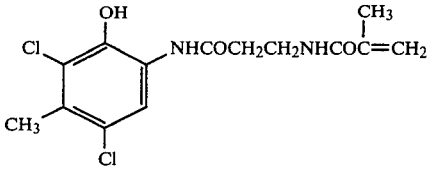
Monomer Coupler (10)
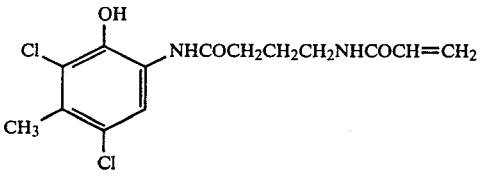
Monomer Coupler (11)
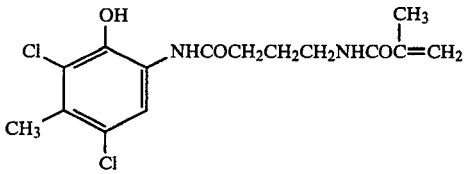
Monomer Coupler (12)
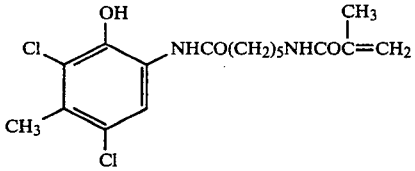
Monomer Coupler (13)
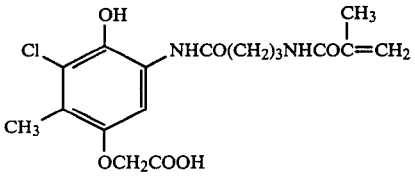
Monomer Coupler (14)
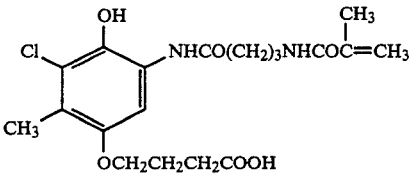
Monomer Coupler (15)
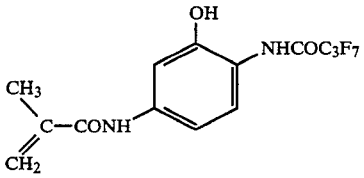
Monomer Coupler (16)

-continued

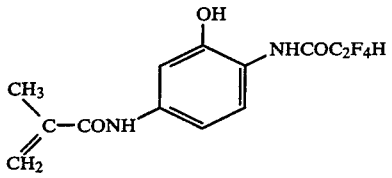

Monomer Coupler (17)

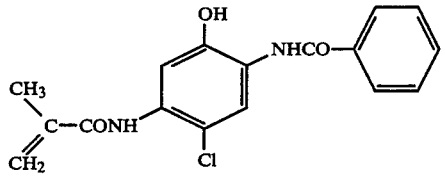

Monomer Coupler (18)

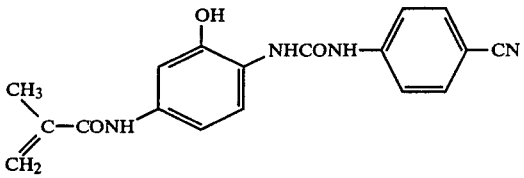

Monomer Coupler (19)

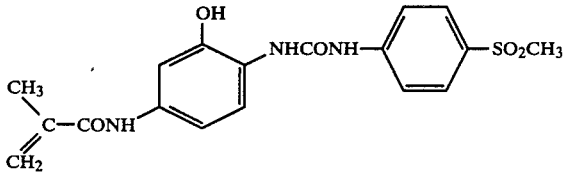

Monomer Coupler (20)

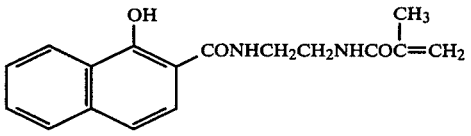

Monomer Coupler (21)

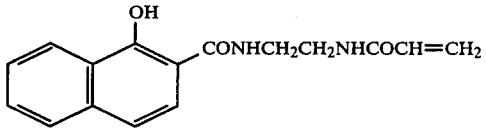

Monomer Coupler (22)

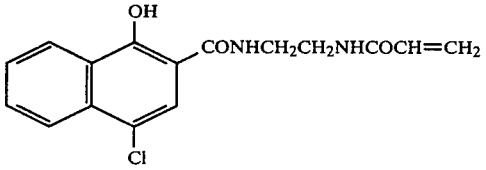

Monomer Coupler (23)

-continued

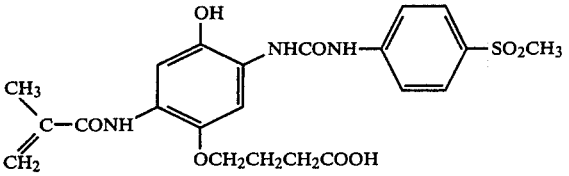

Monomer Coupler (24)

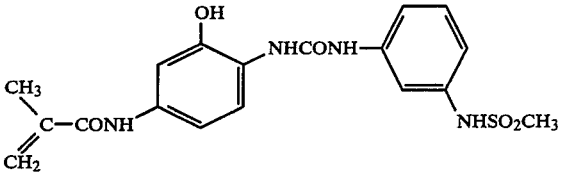

Monomer Coupler (25)

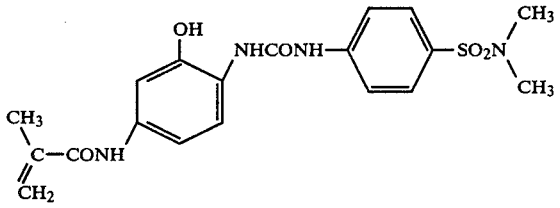

Typical synthesis examples of the monomer compounds and the polymer compounds according to the present invention are set forth below.

A. Monomer Compounds

SYNTHESIS EXAMPLE 1

Synthesis of 6-(3-methacrylamidopropanamido)-2,4-dichloro-3-methylphenol [Monomer Coupler (9)]

In a mixture composed of 80 g (2.0 mols) of sodium hydroxide, 400 ml of water and 4 ml of nitrobenzene was dissolved 178 g (2.0 mols) of $\beta$-alanine with stirring and the resulting solution was cooled to 0° C. To the aqueous solution, there were simultaneously added dropwise 230 g (2.2 mols) of methacrylic chloride and an aqueous solution containing 96 g (2.4 mols) of sodium hydroxide dissolved in 200 ml of water. After the completion of the reaction, 800 ml of acetonitrile was added to the reaction solution and the mixture was then acidified by adding 160 ml of concentrated hydrochloric acid. 1 Liter of acetonitrile was further added to extract and the acetonitrile layer was separated. The acetonitrile solution was concentrated and the crystals thus deposited were collected and recrystallized from ethyl acetate to obtain 142 g of N-methacryloyl-$\beta$-alanine.

To a mixture composed of 76 g (0.48 mol) of N-methacryloyl-$\beta$-alanine obtained in the above-described manner and 46 g (0.2 mol) of 6-amino-2,4-dichloro-3-methylphenol hydrochloride were added 114 ml (1.44 mols) of pyridine and 1 liter of ethyl acetate and stirred under cooling. To the solution was added dropwise 29 ml (0.4 mol) of thionyl chloride. After the completion of the reaction, 300 ml of water was added to the reaction solution and extracted with ethyl acetate. The ethyl acetate solution was concentrated and the crystals thus deposited were collected and recrystallized from acetonitrile to obtain 48.2 g of Monomer Coupler (9). Melting Point 150° to 152° C.

Elemental Analysis for $C_{14}H_{16}N_2O_3$ $Cl_2$:

| | C | H | N |
|---|---|---|---|
| Calculated (%): | 50.76 | 4.83 | 8.46 |
| Found (%): | 50.69 | 4.69 | 8.51 |

SYNTHESIS EXAMPLE 2

Synthesis of 6-(2-methacrylamidoacetamido)-2,4-dichloro-3-methylphenol [Monomer Coupler (5)]

In a mixture composed of 80 g (2.0 mols) of sodium hydroxide, 400 ml of water and 4 ml of nitrobenzene was dissolved with stirring 150 g (2.0 mols) of glycine and the resulting solution was cooled to 0° C. To the aqueous solution, there were simultaneously added dropwise 230 g (2.2 mols) of methacrylic chloride and an aqueous solution containing 96 g (2.4 mols) of sodium hydroxide dissolved in 200 ml of water. After the completion of the reaction, 800 ml of acetonitrile was added to the reaction solution and the mixture was then acidified by adding 160 ml of concentrated hydrochloric acid. 1 Liter of acetonitrile was further added to extract and the acetonitrile layer was separated. The acetonitrile solution was concentrated and the crystals thus deposited were collected and recrystallized from ethyl acetate to obtain 117 g of N-methacryloyl glycine.

To mixture composed of 68 g (0.48 mol) of N-methacryloyl glycine obtained in the above-described manner and 46 g (0.2 mol) of 6-amino-2,4-dichloro-3-methylphenol hydrochloride were added 114 ml (1.44 mols) of pyridine and 1 liter of ethyl acetate and stirred under cooling. To the solution was added dropwise 29 ml (0.4 mol) of thionyl chloride. After the completion of the reaction, 300 ml of water was added to the reaction solution and extracted with ethyl acetate. The ethyl acetate solution was concentrated and to the residue was added acetonitrile. The crystals thus deposited were collected and recrystallized from acetonitrile to obtain 34.8 g of Monomer Coupler (5).

Melting Point: 217° to 218° C.

Elemental Analysis for $C_{13}H_{14}Cl_2N_2O_3$:

| | C | H | N |
|---|---|---|---|
| Calculated (%): | 49.23 | 4.45 | 8.83 |
| Found (%): | 49.18 | 4.43 | 8.95 |

SYNTHESIS EXAMPLE 3

Synthesis of 6-(4-methacrylamidobutanamido)-2,4-dichloro-3-methylphenol [Monomer Coupler (11)]

In a mixture composed of 80 g (2.0 mols) of sodium hydroxide, 400 ml of water and 4 ml of nitrobenzene was dissolved with stirring 214 g (2.0 mols) of γ-aminobutyric acid and the resulting solution was cooled to 0° C. To the aqueous solution, there were simultaneously. added dropwise 230 g (2.2 mols) of methacrylic chloride and an aqueous solution containing 96 g (2.4 mols) of sodium hydroxide dissolved in 200 ml of water. After the completion of the reaction, 800 ml of acetonitrile was added to the reaction solution and the mixture was then acidified by adding 160 ml of concentrated hydrochloric acid and extracted with acetonitrile. The acetonitrile solution was concentrated to obtain 318.4 g of N-methacryloyl-γ-aminobutyric acid as an oily product.

In the same manner as described in Synthesis Example 1 but using 82 g (0.48 mol) of N-methacryloyl-γ-aminobutyric acid obtained in the above-described manner, 49.3 g of Monomer Coupler (11) was obtained.

Melting Point: 119° to 121° C.

Elemental Analysis for $C_{15}H_{18}Cl_2N_2O_3$:

| | C | H | N |
|---|---|---|---|
| Calculated (%): | 52.18 | 5.25 | 8.12 |
| Found (%): | 52.14 | 5.72 | 8.41 |

SYNTHESIS EXAMPLE 4

Synthesis of 2-heptafluorobutanamido-5-methacrylamidophenol [Monomer Coupler (15)]

To 64 g (0.2 mol) of 2-heptafluorobutanamido-5-aminophenol were added 18 g (0.22 mol) of pyridine and 500 ml of acetonitrile and mixture was cooled with stirring. To the solution was added dropwise 23 g (0.22 mol) of methacrylic chloride. After the completion of the reaction, 500 ml of water was added to the reaction solution and the crystals thus deposited were collected and recrystallized from acetonitrile to obtain 48 g of Monomer Coupler (15).

Melting Point: 247° to 250° C.

Elemental Analysis for $C_{14}H_{10}N_2O_3F_7$:

| | C | H | N |
|---|---|---|---|
| Calculated (%): | 43.42 | 2.61 | 7.23 |
| Found (%): | 43.55 | 2.65 | 7.18 |

SYNTHESIS EXAMPLE 5

Synthesis of 2-(4-cyanophenylureido)-5-methacrylamido-phenol [Monomer Coupler (18)]

10.8 g (0.04 mol) of 2-(4-cyanophenylureido)-5-aminophenol was added to 100 ml of acetonitrile and to which were added 17.6 ml (0.2 mol) of pyridine and 0.3 ml of nitrobenzene while cooling with stirring. To the solution was added dropwise 5.0 g (0.048 mol) of methacrylic chloride and the mixture was stirred for about 1.5 hours. 200 ml of water was added to the reaction mixture and the crystals thus deposited were collected by filtration and recrystallized from acetone to obtain 3.8 g (28.3%) of Monomer Coupler (18).

Melting Point: 247° to 249° C.

Elemental Analysis for $C_{18}H_{16}N_4O_3$:

| | C | H | N |
|---|---|---|---|
| Calculated (%): | 64.27 | 4.80 | 16.66 |
| Found (%): | 64.23 | 4.64 | 16.36 |

SYNTHESIS EXAMPLE 6

Synthesis of N-[β-(1-hydroxy-2-naphthoylamino)ethyl]-methacrylamide [Monomer Coupler (20)]

To 56 g (0.2 mol) of N-(1-hydroxy-2-naphthoyl)ethylenediamine hydrochloride were added 114 ml (1.44 mols) of pyridine and 800 ml of acetonitrile and the mixture was cooled with stirring. To the solution was added dropwise 46 g (0.44 mol) of methacrylic chloride. After the completion of the reaction, 400 ml of water was added to the reaction solution and extracted with ethyl acetate. The ethyl acetate solution was concentrated, to the residue was added 1 liter of methanol and the mixture was cooled with stirring. To the solution was added 300 ml of a methanol solution containing 13 g of potassium hydroxide dissolved and the mixture was stirred for about 30 minutes and neutralized with acetic acid. 1.6 liters of water was added to the mixture and the crystals thus deposited were collected and recrystallized from acetonitrile to obtain 37.9 g of Monomer Coupler (20).

Melting Point: 167° to 169° C.

Elemental Analysis for $C_{17}H_{18}N_2O_3$:

| | C | H | N |
|---|---|---|---|
| Calculated (%): | 68.44 | 6.09 | 9.39 |
| Found (%): | 68.56 | 6.17 | 9.41 |

B. Polymer Compounds

Synthesis Method I

SYNTHESIS EXAMPLE 7

Synthesis of copolymer coupler of 6-methacrylamido-2,4-dichloro-3-methylphenol, [Monomer Coupler (1)], methyl acrylate and diacetoneacrylamide (Oleophilic Polymer Coupler (I)]

A mixture composed of 20 g of Monomer Coupler (1), 16 g of methyl acrylate, 4 g of diacetoneacrylamide and 200 ml of dioxane was heated to 80° C. with stirring while introducing nitrogen gas. To the mixture was added 10 ml of a dioxane containing 300 mg of dimethyl 2,2'-azobisisobutyrate dissolved to initiate polymerization. After reacting for 5 hours, the reaction solution was cooled and poured into 2 liters of water. The solid thus deposited were collected by filtration and thoroughly washed with water. By drying the solid under a reduced pressure with heating, 38.2 g of Oleophilic Polymer Coupler (I) was obtained. It was found that the oleophilic polymer coupler contained 51.2% of Monomer Coupler (1) in the copolymer synthesized as the result of chlorine analysis.

A method for dispersing Oleophilic Polymer Coupler (I) in an aqueous gelatin solution in a form of latex is described in the following.

Synthesis of Polymer Coupler Latex (I')

Two solutions (a) and (b) were prepared in the following manner.

Solution (a): 300 g of a 5% by weight aqueous solution of bone gelatin (pH of 5.6 at 35° C.) was heated to 32° C. and to which was added 12 ml of a 10% by weight aqueous solution of sodium lauryl sulfate.

Solution (b): 20 g of Oleophilic Polymer Coupler (I) described above was dissolved in 60 g of ethyl acetate at 38° C.

Solution (b) was put into a mixer with explosion preventing equipment while stirring at a high speed to which was rapidly added solution (a). After stirring for 1 minute, the mixer was stopped and ethyl acetate was removed by distillation under a reduced pressure. Thus, the oleophilic polymer coupler was dispersed in a diluted gelatin solution to prepare Polymer Coupler Latex (I').

SYNTHESIS EXAMPLE 8

Synthesis of copolymer coupler of 6-acrylamido-2,4-dichloro-3-methylphenol [Monomer Coupler (2)] and t-butylacrylamide [Oleophilic Polymer Coupler (II)]

A mixture composed of 20 g of Monomer Coupler (2), 80 g of t-butylacrylamide and 500 ml of dioxane was heated to 80° C. with stirring while introducing nitrogen gas. To the mixture was added 10 ml of dioxane containing 800 mg of azobisisobutyronitrile dissolved to initiate polymerization. After reacting for 3 hours the temperature was raised to 100° C. and the mixture was further reacted for 2 hours. The resction solution was cooled and poured into 5 liters of water. The solid thus deposited was collected by filtration and thoroughly washed with water. By drying the solid under a reduced pressure with heating, 96.3 g of Oleophilic Polymer Coupler (II) was obtained. It was found that the oleophilic polymer coupler contained 20.8% of Monomer Coupler (2) in the copolymer synthesized as the result of chlorine analysis.

A method for dispersing Oleophilic Polymer Coupler (II) in an aqueous gelatin solution in a form of latex is described in the following.

Synthesis of Polymer Coupler Latex (II')

Two solutions (a) and (b) were prepared in the following manner.

Solution (a): 200 g of a 3.0% by weight aqueous solution of bone gelatin (pH of 5.6 at 35° C.) was heated to 38° C. and to which was added 16 ml of a 10% by weight aqueous solution of sodium lauryl sulfate.

Solution (b): 20 g of Oleophilic Polymer Coupler (II) described above was dissolved in 200 ml of ethyl acetate at 38° C.

Solution (b) was put into a mixer with explosion preventing equipment while stirring at high speed and to which was rapidly added solution (a). After stirring for 1 minute, the mixer was stopped and ethyl acetate was removed by distillation under a reduced pressure. Thus, the oleophilic polymer coupler was dispersed in a diluted gelatin solution to prepare Polymer Coupler Latex (II').

SYNTHESIS EXAMPLE 9

Synthesis of copolymer coupler of 6-(4-methacrylamidobutanamido)-2,4-dichloro-3-methylphenol [Monomer Coupler (11)], methyl acrylate and diacetoneacrylamide [Oleophilic Polymer Coupler (III)]

A mixture composed of 150 g of Monomer Coupler (11), 120 g of methyl acrylate, 30 g of diacetoneacrylamide and 1.5 liters of dioxane was heated to 80° C. with stirring while introducing nitrogen gas. To the mixture was added 50 ml of dioxane containing 3 g of azobisisobutyronitrile dissolved to initiate polymerization. After reacting for 3 hours, the temperature was raised to 100° C. and the mixture was further reacted for 2 hours. The reaction solution was cooled and poured into 10 liters of ice water. The solid thus deposited was collected by filtration and thoroughly washed with water. By drying the solid under a reduced pressure with heating, 281 g of Oleophilic Polymer Coupler (III) was obtained. It was found that the oleophilic polymer coupler contained 50.4% of Monomer Coupler (11) in the copolymer synthesized as the result of chlorine analysis.

A method for dispersing Oleophilic Polymer Coupler (III) in an aqueous gelatin solution in a form of latex is described in the following.

Synthesis of Polymer Coupler Latex (III')

Two solutions (a) and (b) were prepared in the following manner.

Solution (a): 200 g of a 3.0% by weight aqueous solution of bone gelatin (pH of 5.6 at 35° C.) was heated to 38° C. and to which was added 16 ml of a 10% by weight aqueous solution of sodium lauryl sulfate.

Solution (b): 20 g of Oleophilic Polymer Coupler (III) described above was dissolved in 200 ml of ethyl acetate at 38° C.

Solution (b) was put into a mixer with explosion preventing equipment while stirring at high speed and to which was rapidly added solution (a). After stirring for 1 minute, the mixer was stopped and ethyl acetate was removed by distillation under a reduced pressure. Thus, the oleophilic polymer coupler was dispersed in a diluted gelatin solution to prepare Polymer Coupler Latex (III').

SYNTHESIS EXAMPLES 10 TO 46

Using the above-described monomer couplers, the oleophilic polymer couplers described below were prepared in the same manner as described for the copolymers in Synthesis Examples 7, 8 and 9 (Synthesis Method I).

Oleophilic Polymer Couplers by Synthesis Method I

| Synthesis Example | Oleophilic Polymer Coupler | Monomer Coupler | Amount (g) | Non-Color Forming Amide Monomer | Amount (g) | Non-Color Forming Monomer | Amount (g) | Monomer Coupler Unit in Polymer (wt. %) |
|---|---|---|---|---|---|---|---|---|
| 10 | IV | (1) | 20 | DAAM | 8 | MA | 12 | 50.5 |
| 11 | V | (1) | 20 | DAAM | 12 | MA | 8 | 50.9 |
| 12 | VI | (1) | 30 | DAAM | 70 | — | — | 30.4 |
| 13 | VII | (1) | 20 | n-BAM | 20 | — | — | 51.2 |
| 14 | VIII | (2) | 20 | DAAM | 4 | MA | 16 | 50.9 |
| 15 | IX | (2) | 20 | t-BAM | 10 | EHA | 10 | 51.0 |
| 16 | X | (2) | 20 | n-BAM | 30 | — | — | 42.2 |
| 17 | XI | (3) | 20 | MAM | 4 | BA | 16 | 52.1 |
| 18 | XII | (3) | 30 | t-BAM | 70 | — | — | 30.9 |
| 19 | XIII | (4) | 20 | AM | 2 | MA | 18 | 52.3 |
| 20 | XIV | (4) | 20 | DAAM | 15 | EA | 15 | 41.7 |
| 21 | XV | (5) | 20 | DAAM | 4 | MA | 16 | 50.8 |
| 22 | XVI | (5) | 30 | t-BAM | 30 | BA | 30 | 34.2 |
| 23 | XVII | (6) | 20 | DAAM | 12 | MA | 8 | 51.5 |
| 24 | XVIII | (6) | 20 | n-BAM | 30 | — | — | 42.2 |
| 25 | XIX | (7) | 20 | t-BAM | 20 | BA | 20 | 35.1 |
| 26 | XX | (8) | 20 | DAAM | 8 | MA | 12 | 50.8 |
| 27 | XXI | (9) | 20 | n-BAM | 30 | — | — | 41.5 |
| 28 | XXII | (9) | 20 | DAAM | 4 | MA | 16 | 51.1 |
| 29 | XXIII | (10) | 20 | DAAM | 6 | MA | 12 | 51.5 |
| 30 | XXIV | (11) | 20 | n-BAM | 20 | — | — | 52.0 |
| 31 | XXV | (11) | 20 | t-BAM | 4 | MA | 16 | 50.9 |
| 32 | XXVI | (12) | 20 | MAM | 40 | MA | 16 | 52.8 |
| 33 | XXVII | (12) | 30 | DAAM | 70 | — | — | 30.6 |
| 34 | XXVIII | (13) | 20 | t-BAM | 8 | MA | 12 | 50.4 |
| 35 | XXIX | (14) | 20 | n-BAM | 40 | — | — | 34.8 |
| 36 | XXX | (15) | 20 | DAAM | 4 | MA | 12 | 51.2 |
| 37 | XXXI | (15) | 20 | n-BAM | 40 | — | — | 34.8 |
| 38 | XXXII | (16) | 20 | n-OAM | 10 | MA | 10 | 52.5 |
| 39 | XXXIII | (17) | 20 | t-BAM | 10 | EHA | 10 | 51.4 |
| 40 | XXXIV | (18) | 20 | DAAM | 4 | MA | 16 | 50.7 |
| 41 | XXXV | (19) | 20 | DAAM | 12 | BA | 8 | 51.2 |
| 42 | XXXVI | (20) | 20 | DAAM | 4 | MA | 16 | 50.6 |
| 43 | XXXVII | (20) | 20 | n-BAM | 10 | EHA | 10 | 52.4 |
| 44 | XXXVIII | (21) | 20 | t-BAM | 10 | BA | 10 | 51.7 |
| 45 | XXXIX | (22) | 20 | n-OAM | 8 | MA | 12 | 51.5 |
| 46 | XL | (23) | 20 | AM | 2 | BA | 18 | 52.3 |

The amounts of the monomer couplers, the non-color forming amide monomers and the non-color forming monomers in the above table indicate amounts used in the synthesis of the oleophilic polymer couplers.

AM: Acrylamide
MAM: Methacrylamide
n-BAM: n-Butylacrylamide
t-BAM: t-Butylacrylamide
n-OAM: n-Octylacrylamide
DAAM: Diacetoneacrylamide
MA: Methyl Acrylate
EA: Ethyl Acrylate
BA: Butyl Acrylate
EHA: 2-Ethylhexyl Acrylate.

Dispersion of these oleophilic polymer couplers in latexes can be carried out in the same manner as described in Synthesis Examples 7, 8 and 9.

Synthesis Method II

SYNTHESIS EXAMPLE 47

Synthesis of copolymer coupler latex of 6-methacrylamido-2,4-dichloro-3-methylphenol [Monomer Coupler (1)], butyl acrylate and t-butylacrylamide [Polymer Coupler Latex (A)]

A solution composed of 30 g of Monomer Coupler (1), 15 g of butyl acrylate, 15 g of t-butylacrylamide, 3 g of oleyl methyl tauride and 750 ml of water was heated to 80° C. with stirring while introducing nitrogen gas in a 1 liter flask. To the mixture was added 20 ml of a 2% aqueous solution of potassium persulfate to initiate polymerization. After reacting for 1 hour, 100 ml of a 2% aqueous solution of potassium persulfate was added. After further reacting for 1 hour, the butyl acrylate not reacted was distilled off. The latex thus formed was cooled, pH of which was adjusted to 6.0 with a 1 N sodium hydroxide solution and filtered. The concentration of the polymer in the latex formed was 8.1% and it was found that the polymer contained 50.4% of Monomer Coupler (1) as the result of chlorine analysis.

SYNTHESIS EXAMPLE 48

Synthesis of copolymer coupler latex of 6-methacrylamido-2,4-dichloro-3-methylphenol [Monomer Coupler (1)], methyl acrylate and diacetoneacrylamide [Polymer Coupler Latex (B)]

400 ml of an aqueous solution containing 2.2 g of oleyl methyl tauride dissolved was heated to 80° C. with stirring while introducing nitrogen gas in a 1 liter flask. To the aqueous solution were added 2 ml of a 2% aqueous solution of potassium persulfate and 4 g of methyl acrylate. After 1 hour, 20 g of Monomer Coupler (1), 16 g of methyl acrylate, 4 g of diacetoneacrylamide and 200 ml of ethanol were added and then 14 ml of a 2% aqueous solution of potassium persulfate was added. After 1 hour, 6 ml of a 2% aqueous solution of potassium persulfate was added. After further reacting for 1 hour, the methyl acrylate not reacted and the ethanol were distilled off. The latex thus formed was cooled, pH of which was adjusted to 6.0 with a 1 N sodium hydroxide solution and filtered. The concentration of the polymer in the latex formed was 11.9% and it was found that the polymer contained 45.5% of Monomer Coupler (1) as the result of chlorine analysis.

SYNTHESIS EXAMPLE 49

Synthesis of copolymer coupler latex of 6-acrylamido-2,4-dichloro-3-methylphenol [Monomer Coupler (2)] and n-butylacrylamide [Polymer Coupler Latex (C)]

1 Liter of an aqueous solution containing 3 g of oleyl methyl tauride dissolved was heated to 85° C. with stirring while introducing nitrogen gas in a 2 liter flask. To the aqueous solution was added 15 ml of a 2% aqueous solution of potassium persulfate and then was added dropwise over a period of 20 minutes a solution prepared by dissolving with heating 20 g of Monomer Coupler (2) and 40 g of n-butylacrylamide in 300 ml of ethanol. After reacting for 1 hour, 6 ml of a 2% aqueous solution of potassium persulfate was added. After further reacting for 1 hour, the ethanol was distilled off. The latex thus formed was cooled, pH of which was adjusted to 6.0 with a 1 N sodium hydroxide solution and filtered. The concentration of the polymer in the latex formed was 6.2% and it was found that the polymer contained 32.9% of Monomer Coupler (2) as the result of chlorine analysis.

SYNTHESIS EXAMPLES 50 TO 61

Using the above-described monomer couplers, the cyan polymer coupler latexes described below were prepared in the same manner as described for the copolymers in Synthesis Example 49 (Synthesis Method II).

Polymer Coupler Latexes by Synthesis Method II

| Synthesis Example | Polymer Coupler Latex | Monomer Coupler | Amount (g) | Non-Color Forming Amide Monomer | Amount (g) | Non-Color Forming Monomer | Amount (g) | Monomer Coupler Unit in Polymer (wt %) |
|---|---|---|---|---|---|---|---|---|
| 50 | D | (1) | 20 | t-BAM | 20 | — | — | 42.8 |
| 51 | E | (2) | 20 | DAAM | 4 | MA | 16 | 53.1 |
| 52 | F | (5) | 20 | DAAM | 6 | MA | 14 | 52.8 |
| 53 | G | (8) | 20 | DAAM | 40 | — | — | 34.2 |
| 54 | H | (9) | 20 | DAAM | 4 | MA | 16 | 52.5 |
| 55 | I | (10) | 20 | n-BAM | 8 | BA | 12 | 51.7 |
| 56 | J | (11) | 20 | DAAM | 4 | MA | 16 | 51.8 |
| 57 | K | (12) | 30 | DAAM | 70 | — | — | 31.6 |
| 58 | L | (15) | 20 | t-BAM | 4 | BA | 16 | 50.3 |
| 59 | M | (19) | 20 | DAAM | 40 | — | — | 35.3 |
| 60 | N | (20) | 20 | DAAM | 6 | MA | 14 | 50.2 |
| 61 | O | (21) | 20 | n-BAM | 8 | BA | 12 | 52.5 |

The amounts of the monomer couplers, the non-color forming amide monomers and the non-color forming monomers in the above table indicate amounts used in the synthesis of the polymer coupler latexes.

The cyan polymer coupler latex according to the present invention can be used individually or as mixtures of two or more thereof.

The cyan polymer coupler latex according to the present invention can also be used together with a cyan polymer coupler latex, such as those described in U.S. Pat. No. 4,080,211, West German Pat. No. 2,725,591, U.S. Pat. No. 3,926,436 and *Research Disclosure,* No. 21728, etc. However, in this case, it is preferred that an amount of the non-color forming ethylenically unsaturated monomer corresponding to the general formula (II) according to the present invention is at least 5 wt % based on total weight of the cyan polymer coupler latex according to the present invention plus conventional cyan polymer coupler latex.

Further, a dispersion which is prepared by dispersing a hydrophobic cyan color forming coupler such as a phenol coupler or a naphthol coupler, for example, a cyan coupler, as described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411 and 4,004,929, West German patent application (OLS) Nos. 2,414,830 and 2,454,329, Japanese patent application (OPI) Nos. 59838/73, 26034/76, 5055/73, 146828/76 and 73050/80 (the term "OPI" as used herein refers to a "published unexamined Japanese patent application"), etc., in a hydrophilic colloid in a manner as described, for example, in U.S. Pat. Nos. 2,269,158, 2,272,191, 2,304,940, 2,311,020, 2,322,027, 2,360,289, 2,772,163, 2,801,170, 2,801,171 and 3,619,195, British Pat. No. 1,151,590, West German Pat. No. 1,143,707, etc., is loaded into the cyan polymer coupler latex according to the present invention in a manner as described in Japanese patent application (OPI) No. 39853/76, etc., and the resulting latex can be used. It is also possible for the above-described hydrophobic cyan coupler to be loaded into the cyan polymer coupler latex according to the present invention in a manner as described in Japanese patent application (OPI) Nos. 59942/76 and 32552/79, U.S. Pat. No. 4,199,363, etc., and the resulting latex can be used. The term "load" used herein refers to the state in which a hydrophobic cyan coupler is incorporated into the interior of a cyan polymer coupler latex, or a state in which a hydrophobic cyan coupler is deposited on the surface of a cyan polymer coupler latex. However, the mechanism by which the load occurs is not accurately known.

In order to satisfy the characteristics required of the photographic light-sensitive material, a dispersion which is prepared by dispersing a development inhibitor releasing (DIR) coupler as described, for example, in U.S. Pat. Nos. 3,148,062, 3,227,554, 3,733,201, 3,617,291, 3,703,375, 3,615,506, 3,265,506, 3,620,745, 3,632,345, 3,869,291, 3,642,485, 3,770,436 and 3,808,945, British Pat. Nos. 1,201,110 and 1,236,767, etc., in a hydrophilic colloid in a manner as described in U.S. Pat. Nos. 2,269,158, 2,272,191, 2,304,940, 2,311,020, 2,322,027, 2,360,289, 2,772,163, 2,801,170, 2,801,171 and 3,619,195, British Pat. No. 1,151,590, West German Pat. No. 1,143,707, etc., is loaded into the cyan polymer coupler latex according to the present invention in a manner as described in Japanese patent application (OPI) No. 39853/76. The resulting latex can then be used, or the above-described DIR coupler is loaded into the cyan polymer coupler latex in a manner as described in Japanese patent application (OPI) Nos. 59942/76 and 32552/79, U.S. Pat. No. 4,199,363, etc., and the resulting latex can then be used.

Furthermore, the cyan polymer coupler latex according to the present invention can be used together with a DIR compound as described, for example, in West German patent application (OLS) Nos. 2,529,350, 2,448,063 and 2,610,546, U.S. Pat. Nos. 3,928,041, 3,958,993, 3,961,959, 4,049,455, 4,052,213, 3,379,529, 3,043,690, 3,364,022, 3,297,445 and 3,287,129.

Moreover, the cyan polymer coupler latex according to the present invention can be used in combination with a competing coupler as described, for example, in U.S. Pat. Nos. 3,876,428, 3,580,722, 2,998,314, 2,808,329, 2,742,832 and 2,689,793, etc., a stain preventing agent as described, for example, in U.S. Pat. Nos. 2,336,327, 2,728,659, 2,336,327, 2,403,721, 2,701,197 and 3,700,453, etc., a dye image stabilizing agent as described, for example, in British Pat. No. 1,326,889, U.S. Pat. Nos. 3,432,300, 3,698,909, 3,574,627, 3,573,050 and 3,764,337, etc., or the like.

The color photographic light-sensitive material produced according to the present invention can also contain conventionally well known coupler(s) other than a cyan color forming coupler. A non-diffusible coupler which contains a hydrophobic group, called a ballast group, in the molecule thereof is preferred as a coupler. A coupler can have either a 4-equivalent or a 2-equivalent property with respect to the silver ion. In addition, a colored coupler providing a color correction effect, or a coupler which releases a development inhibitor upon a development can also be present therein. Furthermore, a coupler which provides a colorless product upon coupling can be employed.

A known open chain ketomethylene type coupler can be used as a yellow color forming coupler. Of these couplers, benzoyl acetanilide type and pivaloyl acetanilide type compounds are especially effective. Specific examples of yellow color forming couplers which can be employed are described, for example, in U.S. Pat. Nos. 2,875,057, 3,265,506, 3,408,194, 3,551,155, 3,582,322, 3,725,072 and 3,891,445, West German Pat. No. 1,547,868, West German patent application (OLS) Nos. 2,219,917, 2,261,361 and 2,414,006, British Pat. No. 1,425,020, Japanese Patent Publication No. 10783/76, Japanese patent application (OPI) Nos. 26133/72, 73147/73, 102636/76, 6341/75, 123342/75, 130442/75, 21827/76 and 87650/75, etc.

A 5-pyrazolone coupler, a pyrazolobenzimidazole coupler, a cyanoacetylcumaron coupler, an open chain acylacetonitrile coupler, etc., can be used as a magenta color forming coupler. Specific examples of magenta color forming couplers which can be employed are described, for example, in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, West German Pat. No. 1,810,464, West German patent application (OLS) Nos. 2,408,665, 2,417,945, 2,418,959 and 2,424,467, Japanese Patent Publication No. 6031/65, Japanese patent application (OPI) Nos. 20826/76, 58922/77, 129538/74, 74027/74, 159336/75, 42121/77, 74028/74, 60233/75, 26541/76 and 55122/78, etc.

Two or more kinds of the couplers described above can be incorporated into the same layer, or the same coupler compound can also be present in two or more layers.

A known method, for example, the method described in U.S. Pat. No. 2,322,027, can be used in order to incorporate the couplers described above into a silver halide emulsion layer. The coupler is dispersed in a hydrophilic colloid and then mixed with a silver halide emulsion. When a coupler having an acid group such as a carboxylic acid group, a sulfonic acid group, etc., is used, it can be incorporated into a hydrophilic colloid as an alkaline aqueous solution thereof.

The silver halide emulsions which can be used in the present invention are those wherein silver chloride, silver bromide, or a mixed silver halide such as silver chlorobromide, silver iodobromide, or silver chloroiodobromide is finely dispersed in a hydrophilic polymer such as gelatin. The silver halide can be chosen depending on the intended use of the photographic light-sensitive material from dispersions having a uniform grain size or those having a wide grain size distribution or from dispersions having an average grain size of from about 0.1 micron to 3 microns. These silver halide emulsions can be prepared, for example, by a single jet method, by a double jet method or a controlled double jet method, or by a ripening method such as an ammonia method, a neutral method, or an acid method. Also, these silver halide emulsions can be subjected to chemical sensitization such as a sulfur sensitization, a gold sensitization, a reduction sensitization, etc., and can contain a speed increasing agent such as a polyoxyethylene compound, an onium compound, etc. Further, a silver halide emulsion of the type wherein latent images are predominantly formed on the surface of the grains or of the type where latent images are predominantly formed inside the grains can be used in the present invention. Also, two or more kinds of silver halide photographic emulsions prepared separately and then mixed can be employed.

Suitable examples of a hydrophilic high molecular weight substance composed of the photographic light-sensitive layer of the present invention include a protein such as gelatin, etc., a high molecular weight non-electrolyte such as polyvinyl alcohol, polyvinyl pyrrolidone, polyacrylamide, etc., an acidic high molecular weight substance such as an alginate, a polyacrylic acid salt, etc., a high molecular weight ampholite such as a polyacrylamide treated with the Hoffman rearrangement reaction, a copolymer of acrylic acid and N-vinylimidazole, etc., a cross-linkable polymer such as those described in U.S. Pat. No. 4,215,195, and the like. Furthermore, a dispersion of a hydrophobic high molecular weight subsrance such as a latex of polybutyl acrylate, etc., can be included in the continuous phase of such a hydrophilic high molecular weight substance.

The silver halide emulsion used in the present invention can be chemically sensitized, as noted above, using conventional methods. Examples of suitable chemical sensitizers include, for example, a gold compound such as a chloroaurate and gold trichloride, as described in U.S. Pat. Nos. 2,399,083, 2,540,085, 2,597,856, and 2,597,915; a salt of a noble metal, such as platinum, palladium, iridium, rhodium and ruthenium, as described in U.S. Pat. Nos. 2,448,060, 2,540,086, 2,566,245, 2,566,263 and 2,598,079; a sulfur compound capable of forming silver sulfide by reacting with a silver salt, such as those described in U.S. Pat. Nos. 1,574,944, 2,410,689, 3,189,458 and 3,501,313; a stannous salt, an amine, and other reducing compounds such as those described in U.S. Pat. Nos. 2,487,850, 2,518,698, 2,521,925, 2,521,926, 2,694,637, 2,983,610 and 3,201,254 and the like.

Various compounds can be added to the photographic emulsions used in the present invention in order to prevent a reduction of the sensitivity or a formation of fog during preparation, storage, or processing. A wide variety of such compounds are known, such as a heterocyclic compound, mercury-containing compound, a mercapto compound or a metal salt, including 4-hydroxy-6-methyl-1,3,3a,7-tetraazaindene, 3-methylbenzothiazole and 1-phenyl-5-mercaptotetrazole, etc. Other examples of such compounds which can be used are described, for example, in U.S. Pat. Nos. 1,758,576, 2,110,178, 2,131,038, 2,173,628, 2,697,040, 2,304,962, 2,324,123, 2,349,198, 2,444,605–8, 2,566,245, 2,694,716, 2,697,099, 2,708,162, 2,728,663–5, 2,476,536, 2,824,001, 2,843,491, 2,886,437, 3,052,544, 3,137,577, 3,220,839, 3,226,231, 3,236,652, 3,251,691, 3,252,799, 3,287,135, 3,326,681, 3,420,668 and 3,622,339, British Pat. Nos. 893,428, 403,789, 1,173,609 and 1,200,188, as well as in K. Mees, *The Theory of the Photographic Process,* 3rd Ed. (1966) and the literature references cited therein.

The photographic emulsion used in the present invention can also contain a surface active agent individually or as a mixture thereof. These surface active agents are commonly used as a coating aid. However, in some cases they are used for the purposes of emulsion dispersion, sensitization, static prevention, adhesion prevention, etc.

The surface active agents can be classified into various groups, as follows: a natural surface active agent such as saponin, etc.; a nonionic surface active agent such as an alkylene oxide, a glycerol and a glycidol, etc.; a cationic surface active agent such as a higher alkylamine, a quaternary ammonium salt, a heterocyclic compound such as pyridine and the like, a phosphonium, a sulfonium, etc.; an anionic surface active agent containing an acid group such as a carboxylic acid group, a sulfonic acid group, a phosphoric acid group, a sulfuric acid ester group, a phosphoric acid ester group, etc.; an amphoteric surface active agent such as an amino acid, an aminosulfonic acid, an amino alcohol sulfuric acid ester, an amino alcohol phosphoric acid ester, etc. Some examples of those surface active agents which can be used are described in U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174, 3,545,974, West German patent application (OLS) No. 1,942,665, British Pat. Nos. 1,077,317 and 1,198,450, as well as Ryohei Oda, et al., *Kaimenkasseizai no Gosei to Sono Oyo* (*Synthesis and Application of Surface Active Agents*), Maki Shoten (1964), A. W. Perry, *Surface Active Agents,* Interscience Publications, Inc. (1958) and J. P. Sisley, *Encyclopedia of Surface Active Agents,* Vol. II, Chemical Publishing Co. (1964), etc.

The photographic emulsion can be spectrally sensitized, or supersensitized, using a cyanine-type dye, such as a cyanine, merocyanine, carbocyanine, etc., individually, in combination, or in combination with a styryl dye.

These spectral sensitization techniques are well known, and are described, for example, in U.S. Pat. Nos. 2,688,545, 2,912,329, 3,397,060, 3,615,635 and 3,628,964, British Pat. Nos. 1,195,302, 1,242,588 and 1,293,862, West German patent application (OLS) Nos. 2,030,326 and 2,121,780, Japanese Patent Publication Nos. 4936/68 and 14030/69, etc. The sensitizers can be selected as desired depending on the wavelength range, sensitivity, etc., due to the purpose and use of the photographic light-sensitive material to be sensitized.

The hydrophilic colloid layer, and in particular, a gelatin layer in the photographic light-sensitive material used in the present invention can be hardened using various kinds of cross-linking agents. For instance, an inorganic compound such as a chromium salt, a zirconium salt, etc., or an aldehyde type cross-linking agent such as mucochloric acid, or 2-phenoxy-3-chloromalealdehydic acid as described in Japanese Patent Publication No. 1872/71 can be effectively used in the present invention. However, a non-aldehyde type cross-linking agent such as a compound having plural epoxy rings as described in Japanese Patent Publication No. 7133/59, a poly(1-aziridinyl) compound as described in Japanese Patent Publication No. 8790/62, an active halogen compound as described in U.S. Pat. Nos. 3,362,827 and 3,325,287, a vinyl sulfone compound as described in U.S. Pat. Nos. 2,994,611 and 3,582,322, Belgian Pat. No. 686,440, etc., are particularly suitable for use in the photographic light-sensitive material of the present invention.

The silver halide photographic emulsion according to the present invention is suitably applied to a support. Illustrative supports include a rigid material such as glass, a metal and a ceramic, and a flexible material and the type of support chosen depends on the end-use objects. Typical examples of flexible supports include a cellulose nitrate film, a cellulose acetate film, a polyvinyl acetal film, a polystyrene film, a polyethylene terephthalate film, a polycarbonate film and a laminate thereof, a baryta coated paper, a paper coated with an α-olefin polymer, such as polyethylene, polypropylene and an ethylene-butene copolymer, a plastic film having a roughened surface as described in Japanese Patent Publication No. 19068/72, and the like. Depending upon the end-use objects of the photographic light-sensitive material, the support can be transparent, colored by adding a dye or pigment, opaque by adding, for example, titanium white, or light-shielding by adding, for example, carbon black.

The layer of the photographic light-sensitive material can be coated on a support using various coating methods, including a dip coating method, an air-knife coating method, a curtain coating method, an extrusion coating method using a hopper as described in U.S. Pat. No. 2,681,294. Also, two or more layers can be coated simultaneously, using methods as described in U.S. Pat. Nos. 2,761,791, 3,508,947, 2,941,898, 3,526,528, etc.

In order to incorporate a coupler into a silver halide emulsion layer, a known method, for example, the method as described in U.S. Pat. No. 2,322,027 can be employed. For example, the coupler may be dissolved in an organic solvent having a high boiling point, for example, a phthalic acid alkyl ester (e.g., dibutyl phthalate, dioctyl phthalate, etc.), a phosphoric acid ester (e.g., diphenyl phosphate, triphenyl phosphate, tricresyl phosphate, dioctylbutyl phosphate, etc.), a citric acid ester (e.g., tributyl acetylcitrate, etc.), a benzoic acid ester (e.g., octyl benzoate, etc.), an alkylamide (e.g., diethyl laurylamide, etc.), a fatty acid ester (e.g., dibutoxyethyl succinate, dioctyl azelate, etc.), a trimesic acid ester (e.g., tributyl trimesate, etc.), etc., or in an organic solvent having a low boiling point of from about 30 to about 150° C., for example, a lower alkyl acetate (e.g., ethyl acetate, butyl acetate, etc.), ethyl propionate, sec-butyl alcohol, methyl isobutyl ketone, β-ethoxyethyl acetate, methyl cellosolve acetate, etc., and then the solution is dispersed in a hydrophilic colloid. The above-described organic solvent having a high boiling point and the above-described organic solvent having a low boiling point may be used as a mixture, if desired.

Furthermore, the dispersing method using a polymeric material as described in Japanese Patent Publication No. 39853/76 and Japanese patent application (OPI) No. 59943/76 can also be used.

When a coupler having an acid group, such as a carboxylic acid group, a sulfonic acid group, etc., is used, it can be incorporated in a hydrophilic colloid as an alkaline aqueous solution thereof.

In practice of the present invention, a known fade-preventing agent can be used. A color image stabilizing agent can be used individually or in a combination two or more thereof. Examples of known fade-preventing agents include a hydroquinone derivative, a gallic acid derivative, a p-alkoxyphenol, a p-oxyphenol derivative or a bisphenol, etc.

Specific examples of hydroquinone derivatives are described in U.S. Pat. Nos. 2,360,290, 2,418,613, 2,675,314, 2,701,197, 2,704,713, 2,728,659, 2,732,300, 2,735,765, 2,710,801 and 2,816,028, British Pat. No. 1,363,921, etc. Specific examples of gallic acid derivatives are described in U.S. Pat. Nos. 3,457,079 and 3,069,262, etc. Specific examples of p-alkoxyphenols are described in U.S. Pat. Nos. 2,735,765 and 3,698,909, Japanese Patent Publication Nos. 20977/74 and 6623/77, etc. Specific examples of p-oxyphenol derivatives are described in U.S. Pat. Nos. 3,432,300, 3,573,050, 3,574,627 and 3,764,337, Japanese patent application (OPI), Nos. 35633/77, 147434/77 and 152225/77, etc. Specific examples of bisphenols are described in U.S. Pat. No. 3,700,455.

The photographic light-sensitive material of the present invention may contain an ultraviolet light absorbing agent in a hydrophilic colloid layer. For example, a benzotriazole compound substituted with an aryl group (for example, those described in U.S. Pat. No. 3,533,794, etc.), a 4-thiazolidone compound (for example, those described in U.S. Pat. Nos. 3,314,794 and 3,352,681, etc.), a benzophenone compound (for example, those described in Japanese patent application (OPI) No. 2784/71, etc.), a cinnamic acid ester compound (for example, those described in U.S. Pat. Nos. 3,705,805 and 3,707,375, etc.), or a benzoxazole compound (for example, those described in U.S. Pat. No. 3,499,762, etc.) can be employed. Further, an ultraviolet light absorbing coupler (for example, an α-naphthol type cyan dye forming coupler, etc.) or an ultraviolet light absorbing polymer can also be employed. These ultraviolet light absorbing agents may be mordanted in the specific layer. Moreover, these ultraviolet light absorbing agents may be incorporated into the layer containing the cyan polymer coupler according to the present invention.

The present invention is applicable to not only the so-called multilayer type photographic lightsensitive material comprising a support having superimposed thereon emulsion layers, each of which is sensitive to radiation of a substantially different wavelength region and forms color images of a substantially different hue, but also the so-called mixed packet type photographic light-sensitive material comprising a support having coated thereon a layer containing packets which are sensitive to radiation of substantially different wavelength regions and form color images of a substantially different hue. The present invention can be applied to various types of photographic materials, for example, a color negative film, a color positive film, a color reversal film, a color printing paper, a color reversal printing paper, and the like.

The color photographic light-sensitive material of the present invention is, after exposure, subjected to a development processing to form dye images. Development processing includes basically a color development step, a bleaching step and a fixing step. Each step can be carried out individually or two or more steps can be combined as one step where a processing solution having two or more functions is used. Also, each step can be separated into two or more steps. The development processing can further include a pre-hardening step, a neutralization step, a first development (black-and-white development) step, a stabilizing step, a water washing step, and the like, if desired. The temperature of processing can be varied depending on the photographic light-sensitive material, the processing method, and the like. In general, the processing steps are carried out at a temperature from 18° C. to 60° C. These steps need not necessarily be conducted at the same temperature.

A color developer solution is an alkaline solution having a pH of more than 8, preferably from 9 to 12, and containing, as a developing agent, a compound whose oxidation product is capable of forming a colored compound when reacted with a color forming agent, i.e., a color coupler. The developing agent described above include a compound capable of developing an exposed silver halide and having a primary amino group on an aromatic ring, and a precursor which forms such compound. Typical examples of preferred developing agents are, for example, 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 4-amino-3-methyl-N-ethyl-N-β-methanesulfonamidoethylaniline, 4-amino-N,N-dimethylaniline, 4-amino-3-methoxy-N,N-diethylaniline, 4-amino-3-methyl-N-ethyl-N-β-ethoxyethylaniline, 4-amino-3-methoxy-N-ethyl-N-β-methoxyethylaniline, 4-amino-3-β-methanesulfonamidoethyl-N,N-diethylaniline, and a salt thereof (for example, a sulfate, a hydrochloride, a sulfite, a p-toluene sulfonate, and the like). Other developing agents such as those described in U.S. Pat. Nos. 2,193,015 and 2,592,364, Japanese patent application (OPI) No. 64933/73, L. F. A. Mason, *Photographic Processing Chemistry,* pages 226–229, Focal Press, London (1966), T. H. James, *The Theory of the Photographic Process,* 4th Edition, pages 315–320, Macmillan, New York (1977), etc., can be used. Further, an aminophenol as described in T. H. James, *The Theory of the Photographic Process,* 4th Edition, pages 311–315, etc., can be used. Also, a 3-pyrazolidone developing agent can be used together with these developing agents.

The color developing solution can optionally contain various additives. Typical examples of such additives include an alkaline agent (for example, an alkali metal or ammonium hydroxide, carbonate or phosphate, etc.); a pH-adjusting agent or buffer (for example, a weak acid such as acetic acid, boric acid, etc., a weak base, or salt thereof, etc.); a developing accelerator (for example, various pyridinium compounds or cationic compounds such as those described in U.S. Pat. Nos. 2,648,604 and 3,671,247; potassium nitrate; sodium nitrate; a condensation product of polyethylene glycol, and a derivative thereof such as those described in U.S. Pat. Nos. 2,533,990, 2,577,127 and 2,950,970; a nonionic compound such as a polythioether represented by those described in British Pat. Nos. 1,020,033 and 1,020,032; a polymeric compound having a sulfite ester group such as those described in U.S. Pat. No. 3,068,097; an organic amine such as pyridine and ethanolamine; benzyl alcohol; a hydrazine and the like); an antifogging agent (for example, an alkali metal bromide; an alkali metal iodide; a nitrobenzimidazole such as those described in U.S. Pat. Nos. 2,496,940 and 2,656,271; mercaptobenzimidazole; 5-methylbenzotriazole; 1-phenyl-5-mercaptotetrazole; a compound for use in rapid processing such as those described in U.S. Pat. Nos. 3,113,864, 3,342,596, 3,295,976, 3,615,522 and 3,597,199; a thiosulfonyl compound such as those described in British Pat. No. 972,211; a phenazine-N-oxide such as those described in Japanese Patent Publication No. 41675/71; those described in *Kagaku Shashin Binran* (*Manual of Scientific Photography*), Vol. II, pages 29–47, and the like); a stain or sludge preventing agent such as those described in U.S. Pat. Nos. 3,161,513 and 3,161,514, and British Pat. Nos. 1,030,442, 1,144,481 and 1,251,558; an interlayer-effect accelerator disclosed in U.S. Pat. No. 3,536,487; a preservative (for example, a sulfite, a bisulfite, hydroxylamine hydrochloride, 25 formsulfite, an alkanolaminesulfite adduct, etc.) and the like.

The color photographic light-sensitive material of the present invention can be treated with various solutions prior to color development.

In the case of color reversal films, treatment with a first development solution is also carried out prior to the color development. As the first development solution, an alkaline aqueous solution containing at least one developing agent, such as hydroquinone, 1-phenyl-3-pyrazolidone, N-methyl-p-aminophenol and the like can be employed. The solution can also contain an inorganic salt such as sodium sulfate, etc.; a pH-adjusting agent or buffer such as borax, boric acid, sodium hydroxide and sodium carbonate, etc.; a development fog preventing agent such as an alkali metal halide (such as potassium bromide, etc.), and the like.

The additives illustrated above and the amounts thereof employed are well known in the color processing field.

After color development, the color photographic materials are usually bleached and fixed. The process can be effected in a blix bath which combines the bleaching and fixing steps. Various known compounds can be used as a bleaching agent, for example, a ferricyanide, a dichromate; a water-soluble iron (III) salt, a water-soluble cobalt (III) salt; a water-soluble copper (II) salt; a water-soluble quinone; a nitrosophenol, a complex salt of a polyvalent cation such as iron (III), cobalt (III), copper (II), etc., and an organic acid, for example, a metal complex of an aminopolycarboxylic acid such as ethylenediaminetetraacetic acid, nitrilotriacetic acid, iminodiacetic acid, N-hydroxyethylethylenediaminetriacetic acid, etc., malonic acid, tartaric acid, malic acid, diglycolic acid and dithioglycolic acid, and a copper complex salt of 2,6-dipicolinic acid; a peracid such as an alkylperacid, a persulfate, a permanganate and hydrogen peroxide; hypochlorite; chlorine; bromine; bleaching powder; and the like. These can be suitably used, individually or in combination. To the bleaching solution, a bleaching accelerator such as those described in U.S. Pat. Nos. 3,042,520 and 3,241,966, Japanese Patent Publication Nos. 8506/70 and 8836/70 and various other additives can be added.

Any known fixing solution can be used for fixing the photographic material of the present invention. That is, ammonium, sodium, or potassium thiosulfate can be used as a fixing agent at a concentration of about 50 to about 200 g/liter. The fixing solution can further contain a stabilizer such as a sulfite and a metabisulfite; a hardener such as potassium alum; a pH buffer such as an acetate and a borate, and the like.

Bleaching bath, fixing bath and blixing bath as described, for example, in U.S. Pat. No. 3,582,322, Japanese Patent Application (OPI) No. 101934/73, West German Pat. No. 1,051,117, etc., can also be employed.

The present invention will be explained in greater detail with reference to the following examples, but the present invention should not be construed as being limited thereto.

EXAMPLE 1

On a paper support both surfaces of which were laminated with polyethylene were coated a first layer (undermost layer) to a seventh layer (uppermost layer) as shown in Table 1 below in order to prepare a color photographic light-sensitive material which is designated Sample 1. In Table 1 below, a coating amount is set forth in mg/m$^2$.

TABLE 1

| | | |
|---|---|---|
| Seventh Layer: (protective layer) | Gelatin | (1,000 mg/m$^2$) |
| Sixth Layer: (ultraviolet light absorbing layer) | Ultraviolet light absorbing agent*3 | (1,000 mg/m$^2$) |
| | Ultraviolet light absorbing agent solvent*2 | (250 mg/m$^2$) |
| | Gelatin | (1,200 mg/m$^2$) |
| Fifth Layer: (red-sensitive layer) | Silver chloro-bromide emulsion | |
| | (silver bromide: | 50 mol % |
| | silver: | 300 mg/m$^2$) |
| | Cyan coupler*1 | (400 mg/m$^2$) |
| | Coupler solvent*2 | (400 mg/m$^2$) |
| | Gelatin | (1,000 mg/m$^2$) |
| Fourth Layer: (intermediate layer) | Ultraviolet light absorbing agent*3 | (1,000 mg/m$^2$) |
| | Ultraviolet light absorbing agent solvent*2 | (250 mg/m$^2$) |
| | Gelatin | (1,200 mg/m$^2$) |
| Third Layer (green-sensitive layer) | Silver chloro-bromide emulsion | |
| | (silver bromide: | 50 mol % |
| | silver: | 290 mg/m$^2$) |
| | Magenta coupler*4 | (200 mg/m$^2$) |
| | Coupler solvent*5 | (200 mg/m$^2$) |
| | Gelatin | (1,000 mg/m$^2$) |
| Second Layer: (intermediate layer) | Gelatin | (1,000 mg/m$^2$) |
| First Layer (blue-sensitive layer) | Silver chloro-bromide emulsion | |
| | (silver bromide: | 80 mol % |
| | silver: | 400 mg/m$^2$) |
| | Yellow coupler*6 | (300 mg/m$^2$) |
| | Coupler solvent*7 | (150 mg/m$^2$) |
| | Gelatin | (1,200 mg/m$^2$) |
| Support: | Paper support both surfaces of which were laminated with polyethylene | |

*1Cyan coupler: 2-[α-(2,4-Di-tert-pentylphenoxy)-butanamido]-4,6-dichloro-5-methylphenol
*2Solvent: Dibutyl phthalate
*3Ultraviolet light absorbing agent: 2-(2-Hydroxy-3-sec-butyl-5-tert-butylphenyl)-benzotriazole
*4Magenta coupler: 1-(2,4,6-trichlorophenyl)-3-(2-chloro-5-tetradecanamido)anilino-2-pyrazolin-5-one
*5Coupler solvent: Tricresyl phosphate
*6Yellow coupler: α-Pivaloyl-α-(2,4-dioxo-5,5-dimethyloxazolidin-3-yl)-2-chloro-5-[α-(2,4-di-tert-pentyl-phenoxy)butanamido]acetanilide
*7Coupler solvent: Dioctyl butyl phosphate Sample 2 was prepared in the same manner as described in Sample 1 except that the cyan coupler solvent in Sample 1 was eliminated. Also, Sample 3 was prepared in the same manner as described in Sample 1 except that the oleophilic cyan polymer coupler latex having the structure shown below was used in place of the cyan coupler in Sample 1 and that the cyan coupler solvent was eliminated.

Oleophilic Cyan Polymer Coupler Latex (Comparison)

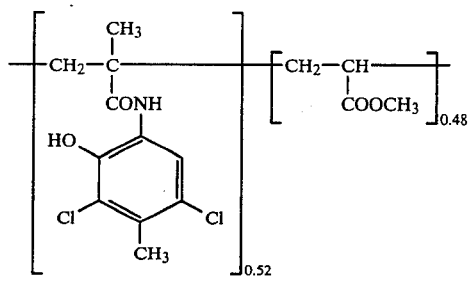

Further, Samples 4, 5, 6 and 7 were prepared in the same manner as described in Sample 1 except that 400 mg/m$^2$ of Oleophilic Polymer Coupler (I), 500 mg/m$^2$ of Oleophilic Polymer Coupler (III), 400 mg/m2 of Oleophilic Polymer Coupler (VIII), and 500 mg/m$^2$ of Oleophilic Polymer Coupler (XV) in the form of a latex according to the present invention were used respectively in place of the cyan coupler in Sample 1 and that the cyan coupler solvent was eliminated.

Each sample was exposed to red light and subjected to color development processing in the following manner.

| Processing Step | Temperature | Time |
|---|---|---|
| Color Development | 33° C. | 3 min 30 sec |
| Bleach-Fixing | 33° C. | 1 min 30 sec |
| Washing with Water | 30° C. | 3 min |
| Drying | | |

The processing solutions used in the color development processing had the following compositions:

| | |
|---|---|
| Color Development Solution | |
| Benzyl Alcohol | 15 ml |
| Sodium Sulfite | 5 g |
| Potassium Bromide | 0.4 g |
| Hydroxylamine Sulfate | 2 g |
| 4-(N—Ethyl-N—β-methanesulfonamido)-2-methylaniline Sesquisulfate | 2 g |
| Sodium Carbonate (monohydrate) | 30 g |
| Water to make | 1,000 ml (pH 10.1) |
| Bleach-Fixing Solution | |
| Ferric Ethylenediaminetetraacetate | 45 g |
| Sodium Sulfite | 10 g |
| Ammonium Thiosulfate (70% aq. soln.) | 160 ml |
| Sodium Ethylenediaminetetraacetate | 5 g |
| Water to make | 1,000 ml (pH 6.8) |

Samples 1 to 7 after development processing were maintained in almost dry atmosphere at 80° C. for 3 weeks and then the density reduction rates of the cyan color images in the areas where the initial densities were 1.0 (D 1.0) and 2.0 (D 2.0) were measured. The results thus obtained are shown in Table 2 below.

TABLE 2

| | 80° C., 3 Weeks | | |
|---|---|---|---|
| Sample | D 1.0 (%) | D 2.0 (%) | Remarks |
| 1 | 48 | 56 | Comparison |
| 2 | 50 | 53 | Comparison |
| 3 | 30 | 32 | Comparison |
| 4 | 15 | 16 | Present Invention |
| 5 | 15 | 15 | Present Invention |

TABLE 2-continued

| Sample | 80° C., 3 Weeks D 1.0 (%) | D 2.0 (%) | Remarks |
|---|---|---|---|
| 6 | 13 | 12 | Present Invention |
| 7 | 11 | 12 | Present Invention |

In Table 2 above, the heat fastness is more excellent as the density reduction rate (%) is small. It is apparent from the results shown in Table 2 above that the cyan couplers according to the present invention have extremely good heat fastness in comparison with the comparison couplers.

EXAMPLE 2

On a cellulose triacetate support were coated a first layer (undermost layer) to a sixth layer (uppermost layer) as shown in Table 3 below in order to prepare a multilayer color photographic light-sensitive material which is designated Sample 8. In Table 3 below, a coating amount is set forth in mg/m$^2$.

TABLE 3

| | | |
|---|---|---|
| Sixth Layer: (protective layer) | Gelatin | (750 mg/m$^2$) |
| Fifth Layer: (green-sensitive layer) | Silver chlorobromide emulsion | |
| | (silver bromide: | 30 mol % |
| | silver: | 500 mg/m$^2$) |
| | Magenta coupler*1 | (600 mg/m$^2$) |
| | Coupler solvent*2 | (110 mg/m$^2$) |
| | Gelatin | (1,300 mg/m$^2$) |
| Fourth Layer: (intermediate layer) | Gelatin | (500 mg/m$^2$) |
| Third Layer: (red-sensitive layer) | Silver chlorobromide emulsion | |
| | (silver bromide: | 30 mol % |
| | silver: | 500 mg/m$^2$) |
| | Cyan coupler*3 | (1,500 mg/m$^2$) |
| | Coupler solvent*4 | (700 mg/m$^2$) |
| | Gelatin | (2,900 mg/m$^2$) |
| Second Layer: (intermediate layer) | Gelatin | (500 mg/m$^2$) |
| First Layer: (blue-sensitive layer) | Silver iodobromide emulsion | |
| | (silver iodide: | 0.2 mol % |
| | silver: | 100 mg/m$^2$) |
| | Yellow coupler*5 | (1,200 mg/m$^2$) |
| | Coupler solvent*6 | (600 mg/m$^2$) |
| | Gelatin | (2,200 mg/m$^2$) |
| Support | Cellulose triacetate | |

*1Magenta coupler: 3-{3-[2-(2,4-Di-tert-pentylphenoxy)-acetamido]benzamido}-1-(2,4,6-trichlorophenyl)-2-pyrazolin-5-one
*2Coupler solvent: Tricresyl phosphate
*3Cyan coupler: 2-[α-(2,4-Di-tert-pentylphenoxy)-butanamido]-4,6-dichloro-5-methyl-phenol
*4Coupler solvent: Cibutyl phthalate
*5Yellow coupler: α-Pivaloyl-α-(2,4-dioxo-5,5-dimethyloxazolidin-3-yl)-2-chloro-5-[α-(2,4-di-tert-pentylphenoxy)-butanamido]acetanilide
*6Coupler solvent: Tricresyl phosphate Sample 9 was prepared in the same manner as described in Sample 8 except that the cyan coupler solvent in Sample 8 was eliminated. Also, Samples 10, 11, 12, 13 and 14 were prepared in the same manner as described in Sample 8 except that 1,500 mg/m$^2$ of the oleophilic polymer coupler in the form of a latex used in Sample 3 in Example 1, and 1,500 mg/m$^2$ of Oleophilic Polymer Coupler (VII), 2,000 mg/m$^2$ of Oleophilic Polymer Coupler (XXIV) and 2,000 mg/m$^2$ of Oleophilic Polymer Coupler (XXV) in the form of a latex according to the present invention, and 1,500 mg/m$^2$ (in an amount of the polymer coupler) of Polymer Coupler Latex (B) according to the present invention were used respectively in place of the cyan coupler in Sample 8 and that the cyan coupler solvent was eliminated.

Each sample was exposed to blue light, green light and red light through a continuous wedge and subjected to the following color development processing.

| Processing Step | Temperature | Time |
|---|---|---|
| Color Development | 36° C. | 3 min |
| Stopping | 36° C. | 40 sec |
| First Fixing | 36° C. | 40 sec |
| Bleaching | 36° C. | 1 min |
| Second Fixing | 36° C. | 40 sec |
| Washing with Water | 30° C. | 30 sec |
| Drying | | |

The processing solutions used in the color development processing had the following compositions:

| | |
|---|---|
| Color Development Solution | |
| Sodium Sulfite | 5 g |
| 4-Amino-3-methyl-N,N—diethylaniline | 3 g |
| Sodium Carbonate | 20 g |
| Potassium Bromide | 2 g |
| Water to make | 1 liter |
| | (pH: 10.5) |
| Stopping Solution | |
| 6 N Sulfuric Acid | 50 ml |
| Water to make | 1 liter |
| | (pH: 1.0) |
| Fixing Solution | |
| Ammonium Thiosulfate | 60 g |
| Sodium Sulfite | 2 g |
| Sodium Hydrogensulfite | 10 g |
| Water to make | 1 liter |
| | (pH: 5.8) |
| Bleaching Solution | |
| Potassium Ferricyanide | 30 g |
| Potassium Bromide | 15 g |
| Water to make | 1 liter |
| | (pH: 6.5) |

The color density at the portion exposed to red light in each sample after development processing was measured. The fog, gamma and maximum density in each sample are shown in Table 4 below.

TABLE 4

| Sample | Fog | Gamma | Maximum Density | Remarks |
|---|---|---|---|---|
| 8 | 0.07 | 3.12 | 3.42 | Comparison |
| 9 | 0.06 | 2.99 | 3.01 | Comparison |
| 10 | 0.06 | 2.36 | 2.51 | Comparison |
| 11 | 0.06 | 3.09 | 3.35 | Present Invention |
| 12 | 0.06 | 3.07 | 3.30 | Present Invention |
| 13 | 0.06 | 3.12 | 3.38 | Present Invention |
| 14 | 0.07 | 3.01 | 3.04 | Present Invention |

As is apparent from the results shown in Table 4 above, in Sample 10 containing the latex of the oleophilic cyan polymer coupler for comparison the color formation is inferior. On the contrary, Samples 11 to 14 containing the cyan polymer coupler latexes according to the present invention have excellent color forming properties.

Further, Samples 8 to 14 after development processing were maintained in an almost dry atmosphere at 80° C. for 2 weeks and then the density reduction rates of the cyan color image in the areas where the initial densities were 1.0 (D 1.0) and 2.0 (D 2.0) were measured. The results thus obtained are shown in Table 5 below.

TABLE 5

| Sample | 80° C., 2 Weeks D 1.0 (%) | D 2.0 (%) | Remarks |
|---|---|---|---|
| 8 | 72 | 77 | Comparison |
| 9 | 65 | 64 | Comparison |
| 10 | 29 | 32 | Comparison |
| 11 | 9 | 10 | Present Invention |
| 12 | 10 | 12 | Present Invention |
| 13 | 12 | 11 | Present Invention |
| 14 | 12 | 15 | Present Invention |

It is apparent from the results shown in Table 5 above that the cyan polymer couplers according to the present invention have excellent heat fastness.

EXAMPLE 3

Samples 15 and 16 were prepared in the same manner as described in Samples 1 and 3 in Example 1. Also, Sample 17 was prepared in the same manner as described in Sample 16 except that 400 mg/m$^2$ of Oleophilic Polymer Coupler (I) in the form of a latex according to the present invention was used in place of the cyan coupler in Sample 16. Further, Samples 18, 19 and 20 were prepared in the same manner as described in Sample 16 except that the amount of the silver chlorobromide emulsion in the red-sensitive layer was changed to 600 mg/m$^2$ and that 600 mg/m$^2$ of Oleophilic Polymer Coupler (XXX), 500 mg/m$^2$ of Oleophilic Polymer Coupler (XXXIV) and 450 mg/m$^2$ of Oleophilic Polymer Coupler (XXXVI) in the form of a latex according to the present invention were used respectively in place of the cyan coupler in Sample 16.

Each sample was exposed to red light through a continuous wedge and subjected to the development processing as described in Example 1. Samples 15 to 20 after development processing were maintained in almost dry atmosphere at 80° C. for 3 weeks and then the density reduction rates of the cyan color images in the areas where the initial densities were 1.0 (D 1.0) and 2.0 (D 2.0) were measured. The results thus obtained are shown in Table 6 below.

TABLE 6

| Sample | 80° C., 2 Weeks D 1.0 (%) | D 2.0 (%) | Remarks |
|---|---|---|---|
| 15 | 50 | 53 | Comparison |
| 16 | 33 | 31 | Comparison |
| 17 | 13 | 15 | Present Invention |
| 18 | 7 | 6 | Present Invention |
| 19 | 6 | 8 | Present Invention |
| 20 | 15 | 14 | Present Invention |

It is apparent from the results shown in Table 6 above that the cyan polymer couplers according to the present invention have excellent heat fastness.

EXAMPLE 4

70 g of each of the emulsified dispersions of Oleophilic Polymer Couplers (I), (VII), (X), (XXII) and (XXVII) and the cyan couplers used in Samples 1 and 3 in Example 1 for comparison containing $7.5\times10^{-3}$ mol of a cyan coupler was mixed with 100 g of a photographic emulsion containing $8.4\times10^{-2}$ mol of a silver iodobromide and 10 g of gelatin and the mixture was coated on a cellulose triacetate film in a silver coated amount of $1.2\times10^{-3}$ mol/m$^2$ to prepare Samples 21, 22, 23, 24, 25, 26 and 27, respectively.

These films were exposed stepwise through a continuous wedge for sensitometry and then subjected to the following color development processing.

| Color Development Processing Step (38° C.) | Time (min) |
|---|---|
| 1. First Development | 3 |
| 2. Washing with Water | 1 |
| 3. Reversal | 2 |
| 4. Color Development | 6 |
| 5. Control | 2 |
| 6. Bleaching | 6 |
| 7. Fixing | 4 |
| 8. Washing with Water | 4 |
| 9. Stabilizing | 1 |
| 10. Drying | |

The processing solutions used in the color development processing had the following compositions:

| | |
|---|---|
| **First Development Solution** | |
| Water | 800 ml |
| Sodium Tetrapolyphosphate | 2.0 g |
| Sodium Hydrogensulfite | 8.0 g |
| Sodium Sulfite | 37.0 g |
| 1-Phenyl-3-pyrazolidone | 0.35 g |
| Hydroquinone | 5.5 g |
| Sodium Carbonate Monohydrate | 28.0 g |
| Potassium Bromide | 1.5 g |
| Potassium Iodide | 13.0 mg |
| Sodium Thiocyanate | 1.4 g |
| Water to make | 1.0 liter |
| **Reversal Solution** | |
| Water | 800 ml |
| Hexasodium Nitrilo-N,N,N—trimethylene Phosphonate | 3.0 g |
| Stannous Chloride Dihydrate | 1.0 g |
| Sodium Hydroxide | 8.0 g |
| Glacial Acetic Acid | 15.0 ml |
| Water to make | 1.0 liter |
| **Color Development Solution** | |
| Water | 800 ml |
| Sodium Tetrapolyphosphate | 2.0 g |
| Benzyl Alcohol | 5.0 ml |
| Sodium Sulfite | 7.5 g |
| Trisodium Phosphate (12 hydrate) | 36.0 g |
| Potassium Bromide | 1.0 g |
| Potassium Iodide | 90.0 mg |
| Sodium Hydroxide | 3.0 g |
| Citrazinic Acid | 1.5 g |
| 4-Amino-3-methyl-N—ethyl-N—(β-hydroxyethyl)aniline Sesquisulfate Monohydrate | 11.0 g |
| Ethylenediamine | 3.0 g |
| Water to make | 1.0 liter |
| **Control Solution** | |
| Water | 800 ml |
| Glacial Acetic Acid | 5.0 ml |
| Sodium Hydroxide | 3.0 g |
| Dimethylaminoethaneisothiourea Dihydrochloride | 1.0 g |
| Water to make | 1.0 liter |
| **Bleaching Solution** | |
| Water | 800 ml |
| Sodium Ethylenediaminetetraacetate Dihydrate | 2.0 g |
| Ammonium Iron (II) Ethylenediaminetetraacetate Dihydrate | 120.0 g |
| Potassium Bromide | 100.0 g |
| Water to make | 1.0 liter |
| **Fixing Solution** | |
| Water | 800 ml |
| Ammonium Thiosulfate | 80.0 g |
| Sodium Sulfite | 5.0 g |
| Sodium Hydrogensulfite | 5.0 g |
| Water to make | 1.0 liter |
| **Stabilizing Bath** | |

-continued

| | |
|---|---|
| Water | 800 ml |
| Formalin (37 wt % formaldehyde) | 5.0 ml |
| Fuji Driwel | 5.0 ml |
| Water to make | 1.0 liter |

Samples 21 to 27 after development processing were maintained in almost dry atmosphere at 80° C. for 2 weeks and then the density reduction rates of the cyan color images in the area where the initial density was 1.0 (D 1.0) were measured. The results thus obtained are shown in Table 7 below.

TABLE 7

| Sample | 80° C., 2 Weeks D 1.0 (%) | Remarks |
|---|---|---|
| 21 | 16 | Present Invention |
| 22 | 11 | Present Invention |
| 23 | 9 | Present Invention |
| 24 | 17 | Present Invention |
| 25 | 8 | Present Invention |
| 26 | 63 | Comparison |
| 27 | 31 | Comparison |

It is apparent from the results shown in Table 7 above that the cyan polymer couplers according to the present invention have extremely good heat fastness.

EXAMPLE 5

Samples 28 and 29 were prepared in the same manner as described in Samples 8 and 10 in Example 2. Also, Samples 30, 31 and 32 were prepared in the same manner as described in Sample 29 except that 400 mg/m$^2$ of Oleophilic Polymer Coupler (I), 400 mg/m$^2$ of Oleophilic Polymer Coupler (IV) and 400 mg/m$^2$ of Oleophilic Polymer Coupler (V) in the form of a latex according to the present invention were used respectively in place of the cyan coupler in Sample 29. Further, Samples 33, 34, 35 and 36 were prepared in the same manner as described in Samples 29, 30, 31 and 32 respectively except that the cyan coupler solvent was further added.

Each sample was exposed to red light through a continuous wedge and subjected to the development processing as described in Example 2. The color density in each sample after development processing was measured. The fog, gamma and maximum density in each sample are shown in Table 8 below.

TABLE 8

| Sample | Fog | Gamma | Maximum Density | Remarks |
|---|---|---|---|---|
| 28 | 0.07 | 3.14 | 3.36 | Comparison |
| 29 | 0.07 | 2.33 | 2.46 | Comparison |
| 30 | 0.06 | 3.11 | 3.33 | Present Invention |
| 31 | 0.07 | 3.09 | 3.30 | Present Invention |
| 32 | 0.06 | 3.06 | 3.24 | Present Invention |
| 33 | 0.06 | 3.04 | 3.35 | Comparison |
| 34 | 0.07 | 3.16 | 3.57 | Present Invention |
| 35 | 0.07 | 3.11 | 3.55 | Present Invention |
| 36 | 0.07 | 3.10 | 3.51 | Present Invention |

As is apparent from the results shown in Table 8 above, the cyan couplers according to the present invention have excellent color forming properties in comparison with the cyan polymer coupler for comparison and the color forming property is further improved when the cyan coupler solvent is added.

TABLE 9

| Sample | 80° C., 2 Weeks D 1.0 (%) | D 2.0 (%) | Remarks |
|---|---|---|---|
| 28 | 62 | 65 | Comparison |
| 29 | 30 | 33 | Comparison |
| 30 | 11 | 10 | Present Invention |
| 31 | 9 | 7 | Present Invention |
| 32 | 5 | 6 | Present Invention |
| 33 | 52 | 56 | Comparison |
| 34 | 14 | 16 | Present Invention |
| 35 | 12 | 10 | Present Invention |
| 36 | 9 | 8 | Present Invention |

Further, Samples 28 to 36 after development processing were maintained in an almost dry atmosphere at 80° C. for 2 weeks and then the density reduction rates of the cyan color image in the areas where the initial densities were 1.0 (D 1.0) and 2.0 (D 2.0) were measured. The results thus obtained are shown in Table 9 below.

It is apparent from the results shown in Table 9 above that the cyan couplers according to the present invention have superior heat fastness to that of the cyan polymer coupler used for comparison. Further, the heat fastness of the samples in which the color forming property is improved by the addition of the cyan coupler solvent decreases as compared with the samples which do not contain the cyan coupler solvent. However, the extent of the decrease in the heat fastness is small for the cyan couplers according to the present invention and the excellent heat fastness is maintained even when the cyan coupler solvent is added.

It is apparent from Examples 1 to 5 above that the cyan color image forming polymer coupler latex of the present invention can provide a cyan color image having excellent heat fastness at high temperature. Similar excellent heat fastness of the cyan color image according to the present invention was obtained at high temperature and high humidity.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having thereon a silver halide emulsion layer containing a cyan color image forming polymer coupler latex capable of forming a dye upon coupling with an oxidation product of an aromatic primary amine developing agent wherein the cyan color image forming polymer coupler latex contains at least one repeating unit represented by the general formula (I) described below and at least one repeating unit represented by the general formula (II) described below:

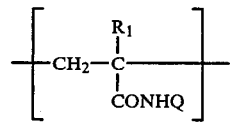

(I)

wherein $R_1$ represents a hydrogen atom, a lower alkyl group containing from 1 to 4 carbon atoms or a chlorine atom; and Q represents a cyan coupler residue capable of forming a dye upon coupling with an oxidized aromatic primary amine developing agent, (II)

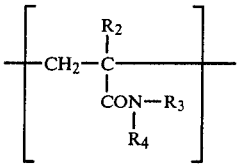

wherein $R_2$ represents a hydrogen atom, a lower alkyl group containing from 1 to 4 carbon atoms or a chlorine atom; and $R_3$ and $R_4$, which may be the same or different, each represents a hydrogen atom, an unsubstituted or substituted alkyl group which may be a straight chain, a branched chain or a cyclic, or an unsubstituted or substituted phenyl group, wherein the repeating unit represented by the general formula (II) is derived from an ethylenically unsaturated monomer which does not have an ability of oxidative coupling with an aromatic primary amine developing agent; and wherein the polymer further contains a repeating unit derived from a non-color forming monomer which does not couple with the oxidation product of an aromatic primary amine developing agent other than the repeating unit represented by the general formula (II).

2. A silver halide color photographic light-sensitive material as claimed in claim 1, wherein the cyan coupler residue represented by Q is a cyan color forming phenol type or naphthol type coupler residue.

3. A silver halide color photographic light-sensitive material as claimed in claim 1, wherein the cyan coupler residue represented by Q is a phenol type residue represented by the following general formula (III), a phenol type residue represented by the following general formula (IV) or a naphthol type residue represented by the following general formula (V):

(III)

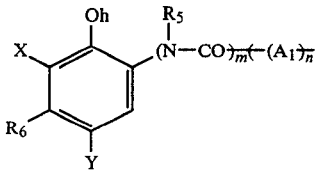

(IV)

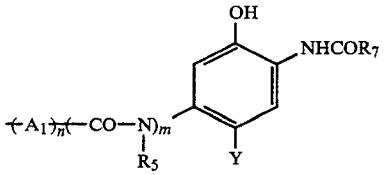

(V)

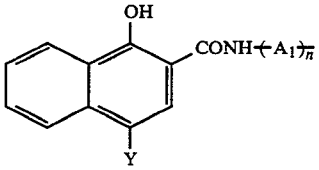

wherein $R_5$ represents a hydrogen atom or a lower alkyl group having from 1 to 4 carbon atoms; $A_1$ bonds to the NH group in the general formula (I) and represents an unsubstituted or substituted alkylene group having from 1 to 10 carbon atoms, an unsubstituted or substituted aralkylene group having from 7 to 12 carbon atoms or an unsubstituted or substituted phenylene group, where the alkylene group and an alkylene moiety in the aralkylene group may be a straight chain or a branched chain; $R_6$ represents a hydrogen atom or a lower alkyl group having from 1 to 5 carbon atoms; $R_7$ represents an unsubstituted or substituted alkyl group having from 1 to 20 carbon atoms, an unsubstituted or substituted phenyl group or an unsubstituted or substituted phenylamino group; X represents a halogen atom; Y represents a hydrogen atom, a halogen atom or a substituted alkoxy group having from 1 to 20 carbon atoms; m represents 0 or 1; and n represents 0 or 1.

4. A silver halide color photographic light-sensitive material as claimed in claim 3, wherein the substituent for the substituted alkylene group, the substituted aralkylene group or the substituted phenylene group represented by $A_1$ is an aryl group, a nitro group, a hydroxy group, a cyano group, a sulfo group, an alkoxy group, an aryloxy group, an acyloxy group, an acylamino group, a sulfonamido group, a sulfamoyl group, a halogen atom, a carboxy group, a carbamoyl group, an alkoxycarbonyl group or a sulfonyl group.

5. A silver halide color photographic light-sensitive material as claimed in claim 3, wherein the substituent for the substituted alkoxy group represented by Y is an aryl group, a nitro group, a hydroxy group, a cyano group, a sulfo group, an alkoxy group, an aryloxy group, an acyloxy group, an acylamino group, an alkylsulfonamido group, an alkylsulfamoyl group, a halogen atom, a carboxy group, an alkylcarbamoyl group, an alkoxycarbonyl group, an alkylsulfonyl group or an alkylthio group.

6. A silver halide color photographic light-sensitive material as claimed in claim 3, wherein the substituent for the substituted alkyl group or the substituted phenyl group represented by $R_7$ is a fluorine atom.

7. A silver halide color photographic light-sensitive material as claimed in claim 3, wherein the substituent for the substituted phenylamino group represented by $R_7$ is a nitro group, a cyano group, a sulfonamido group, a sulfamoyl group, a halogen atom, a carbamoyl group or a sulfonyl group.

8. A silver halide color photographic light-sensitive material as claimed in claim 1, wherein the ethylenically unsaturated monomer is an amide derived from an acrylic acid.

9. A silver halide color photographic light-sensitive material as claimed in claim 1, wherein the substituent for the substituted alkyl group or the substituted phenyl group represented by $R_3$ or $R_4$ is an acetyl group, a hydroxyacetyl group, an acetoacetoxy group, an alkylcarbonyl group, a dialkylamino group, an alkoxycarbonyl group, a hydroxy group, an alkoxy group or a cyano group.

10. A silver halide color photographic light-sensitive material as claimed in claim 8, wherein the amide derived from an acrylic acid is n-butylacrylamide, t-butylacrylamide, n-octylacrylamide, diacetoneacrylamide, hydroxymethylacrylamide, acrylamide, α-chloroacrylamide, n-butylmethacrylamide, t-butylmethacrylamide or methacrylamide.

11. A silver halide color photographic light-sensitive material as claimed in claim 1, wherein the non-color forming monomer is an ester of acrylic acid, a vinyl ester, an acrylonitrile, a methacrylonitrile, an aromatic vinyl compound, itaconic acid, citraconic acid, crotonic acid, vinylidene chloride, a vinyl alkyl ether, an ester of maleic acid, N-vinyl-2-pyrrolidone, N-vinyl pyridine, or 2- or 4-vinyl pyridine.

12. A silver halide color photographic light-sensitive material as claimed in claim 1, wherein the non-color forming monomer is an acrylic acid ester, a methacrylic acid ester or a maleic acid ester.

13. A silver halide color photographic light-sensitive material as claimed in claim 1, wherein the proportion of the color forming portion corresponding to the general formula (I) in the polymer latex is from 5% to 80% by weight.

14. A silver halide color photographic light-sensitive material as claimed in claim 1, wherein the proportion of the color forming portion corresponding to the general formula (I) in the polymer latex is from 20% to 70% by weight.

15. A silver halide color photographic light-sensitive material as claimed in claim 1, wherein the proportion of the non-color forming portion corresponding to the general formula (II) in the polymer latex is from 5% to 90% by weight.

16. A silver halide color photographic light-sensitive material as claimed in claim 1, wherein the proportion of the non-color forming portion corresponding to the general formula (II) in the polymer latex is from 10% to 70% by weight.

17. A silver halide color photographic light-sensitive material as claimed in claim 1, wherein the gram number of the polymer latex containing 1 mol of coupler monomer is from 250 to 4,000.

18. A silver halide color photographic light-sensitive material as claimed in claim 1, wherein the cyan color image forming polymer coupler latex is a latex prepared by emulsion polymerization of monomers comprising a monomer corresponding to the repeating unit represented by the general formula (I) and a monomer corresponding to the repeating unit represented by the general formula (II).

19. A silver halide color photographic light-sensitive material as claimed in claim 1, wherein the cyan color image forming polymer coupler latex is a latex prepared by dissolving an oleophilic polymer coupler obtained by polymerization of monomers comprising a monomer corresponding to the repeating unit represented by the general formula (I) and a monomer corresponding to the repeating unit represented by the general formula (II) in an organic solvent and then dispersing the solution in a latex form in an aqueous gelatin solution.

20. A silver halide color photographic light-sensitive material as claimed in claim 1, wherein the silver halide emulsion layer containing a cyan color image forming polymer coupler latex is a red-sensitive silver halide emulsion layer.

21. A silver halide color photographic light-sensitive material as claimed in claim 20, wherein the photographic light-sensitive material further comprises a blue-sensitive silver halide emulsion layer containing a yellow color image forming coupler and a green-sensitive silver halide emulsion layer containing a magenta color image forming coupler.

22. A silver halide color photographic light-sensitive material as claimed in claim 1, wherein the cyan color image forming polymer coupler latex is used in such that an amount of the color forming portion corresponding to the general formula (I) is from $2\times10^{-3}$ to $5\times10^{-1}$ mol/mol Ag.

23. A method of forming a color image comprising the steps of: providing a silver halide color photographic light-sensitive material comprising a support having thereon a silver halide emulsion layer containing a cyan color image forming polymer coupler latex capable of forming a dye upon coupling with an oxidation product of an aromatic primary amine developing agent wherein the cyan color image forming polymer coupler latex contains at least one repeating unit represented by the general formula (I) described below and at least one repeating unit represented by the general formula (II) described below, wherein the repeating unit represented by the general formula (II) is derived from an ethylenically unsaturated monomer which does not have an ability of oxidative coupling with an aromatic primary amine developing agent; and wherein the polymer further contains a repeating unit derived from a non-color forming monomer which does not couple with the oxidation product of an aromatic primary amine developing agent other than the repeating unit represented by the general formula (II);

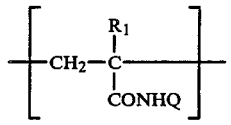

(I)

wherein $R_1$ represents a hydrogen atom, a lower alkyl group containing from 1 to 4 carbon atoms or a chlorine atom; and Q represents a cyan coupler residue capable of forming a dye upon coupling with an oxidized aromatic primary amine developing agent,

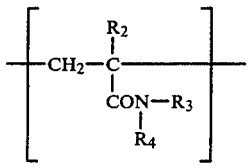

(II)

wherein $R_2$ represents a hydrogen atom, a lower alkyl group containing from 1 to 4 carbon atoms or a chlorine atom; and $R_3$ and $R_4$, which may be the same or different, each represents a hydrogen atom, an unsubstituted or substituted alkyl group which may be a straight chain, a branched chain or a cyclic, or an unsubstituted or substituted phenyl group; imagewise exposing the material; and developing the material using an alkaline aqueous solution containing an aromatic primary amine developing agent.

* * * * *